US007138642B2

(12) United States Patent
Hieke

(10) Patent No.: US 7,138,642 B2
(45) Date of Patent: Nov. 21, 2006

(54) ION SOURCE WITH CONTROLLED SUPERPOSITION OF ELECTROSTATIC AND GAS FLOW FIELDS

(75) Inventor: Andreas Hieke, Cupertino, CA (US)

(73) Assignee: Gemio Technologies, Inc., Menlo Park, CA (US)

( * ) Notice: Subject to any disclaimer, the term of this patent is extended or adjusted under 35 U.S.C. 154(b) by 68 days.

(21) Appl. No.: 11/063,485

(22) Filed: Feb. 22, 2005

(65) Prior Publication Data

US 2005/0194542 A1 Sep. 8, 2005

Related U.S. Application Data

(60) Provisional application No. 60/547,259, filed on Feb. 23, 2004.

(51) Int. Cl.
*H01J 3/14* (2006.01)
*G21K 1/08* (2006.01)

(52) U.S. Cl. ..... 250/400; 250/396 R; 250/281; 250/282; 250/286; 250/287

(58) Field of Classification Search ..... 250/396 R, 250/400
See application file for complete search history.

(56) References Cited

U.S. PATENT DOCUMENTS 4,963,736 A 10/1990 Douglas et al.
5,510,613 A 4/1996 Reilly et al.
5,729,014 A 3/1998 Mordehai et al.
5,739,530 A 4/1998 Franzen et al.
5,818,055 A 10/1998 Franzen
6,107,628 A * 8/2000 Smith et al. ..... 250/292
6,140,638 A 10/2000 Tanner et al.
6,153,880 A 11/2000 Russ, IV et al.
6,225,047 B1 5/2001 Hutchens et al.
6,331,702 B1 12/2001 Krutchinsky et al.
6,515,280 B1 2/2003 Baykut
6,545,268 B1 4/2003 Verentchikov et al.
6,583,408 B1 * 6/2003 Smith et al. ..... 250/288
6,674,071 B1 * 1/2004 Franzen et al. ..... 250/292
6,707,037 B1 3/2004 Whitehouse
6,791,078 B1 * 9/2004 Giles et al. ..... 250/286
6,803,565 B1 * 10/2004 Smith et al. ..... 250/288
6,914,241 B1 * 7/2005 Giles et al. ..... 250/286
6,949,739 B1 * 9/2005 Franzen ..... 250/288
6,967,325 B1 * 11/2005 Smith et al. ..... 250/288
6,977,371 B1 * 12/2005 Bateman et al. ..... 250/288
6,979,816 B1 * 12/2005 Tang et al. ..... 250/288

(Continued)

FOREIGN PATENT DOCUMENTS

EP 0964427 A2 12/1999

(Continued)

OTHER PUBLICATIONS

Bondarenko, P.V. et al., "A New Electrospray-Ionization Time-Of-Flight Mass Spectrometer With Electrostatic Wire Ion Guide", *Intl. J. Mass Spectrom. Ion Processes*, 160, 241-258, 1997.
Hieke, A., "GEMIOS—a 64-Bit multi-physics Gas and Electromagnetic Ion Optical Simulator", *Proceedings of the 51st Conference on Mass Spectrometry and Allied Topics*, Jun. 8-12, 2003, Montreal, PQ, Canada.

(Continued)

*Primary Examiner*—Nikita Wells
*Assistant Examiner*—Bernard E. Souw
(74) *Attorney, Agent, or Firm*—Greenberg Traurig, LLP; Wayne A. Jones; David C. Cohen

(57) ABSTRACT

Ion source devices with controlled superposition of electrostatic and gas flow fields to effect rapid collisional cooling with improved ion collection and collimation, analytical apparatus comprising such ion source devices, and methods for use are presented.

50 Claims, 18 Drawing Sheets

U.S. PATENT DOCUMENTS

| | | | | |
|---|---|---|---|---|
| 2003/0098413 | A1 | 5/2003 | Weinberger et al. | |
| 2003/0136905 | A1* | 7/2003 | Franzen et al. | 250/292 |
| 2004/0031920 | A1* | 2/2004 | Giles et al. | 250/287 |
| 2004/0089803 | A1* | 5/2004 | Foley | 250/288 |
| 2004/0129876 | A1* | 7/2004 | Franzen | 250/288 |
| 2004/0195503 | A1* | 10/2004 | Kim et al. | 250/288 |
| 2004/0211897 | A1* | 10/2004 | Kim et al. | 250/288 |
| 2004/0227071 | A1* | 11/2004 | Giles et al. | 250/287 |
| 2004/0251411 | A1* | 12/2004 | Bateman et al. | 250/293 |
| 2005/0194542 | A1* | 9/2005 | Hieke | 250/400 |
| 2005/0194543 | A1* | 9/2005 | Hieke | 250/400 |
| 2005/0199820 | A1* | 9/2005 | Eastham | 250/396 R |
| 2005/0258354 | A1* | 11/2005 | Baba et al. | 250/281 |
| 2005/0269519 | A1* | 12/2005 | Kim et al. | 250/423 R |
| 2006/0076484 | A1* | 4/2006 | Brown et al. | 250/290 |

FOREIGN PATENT DOCUMENTS

| | | | |
|---|---|---|---|
| WO | WO 99/30351 | | 6/1999 |
| WO | WO 00/77822 | A2 | 12/2000 |
| WO | WO 00/77822 | A3 | 12/2000 |
| WO | WO 02/097857 | A1 | 12/2002 |

OTHER PUBLICATIONS

Hieke, A., Theoretical and Implementational Aspects of an Advanced 3D Gas and Electromagnetic Ion Optical Simulator Interfacing with ANSYS Multiphysics, *Proceedings of the International Congress on FEM Technology*, pp. 1.6:13, Nov. 12-14, 2003, Postdam, Germany.

Hieke, A., "Development of an Advanced Simulation System for the Analysis of Particle Dynamics in LASER based Protien Ion Sources", *Proceedings of the 2004 NSTI Nanotechnology Conference and Trade Show Nanotech 2004*, Mar. 7-11, 2004, Boston, MA, U.S.A.

Krutchinsky, A.N. et al., Orthogonal Injection of Matrix-Assisted Laser Desorption/Ionization Ions Into A Time-Of-Flight Spectrometer Through A Collisional Damping Interface, *Rapid Communic. Mass Spectrom.*, 12, 508-518, 1998.

Loboda, et al., "A tandem quadrupole/time-of-flight mass spectrometer with a matrix-assisted laser desorption/ionization source: design and performance"; *Rapid Communic. Mass Spectrom.*, 14:1047-1057, 2000.

Tsybin, Y.O. et al., "Improved Low-Energy Electron Injection Systems For High Rate Electron Capture Dissociation In Fourier Transform Ion Cyclotron Resonance Mass Spectrometry", *Rapid Communic. Mass Spectrom.*, 15, 1849-1854, 2001.

* cited by examiner

ION SOURCE WITH CONTROLLED SUPERPOSITION OF ELECTROSTATIC AND GAS FLOW FIELDS

CROSS-REFERENCE TO RELATED APPLICATIONS

This application claims the benefit of U.S. provisional patent applications Ser. No. 60/547,259, filed Feb. 23, 2004, the disclosure of which is incorporated herein by reference in its entirety.

BACKGROUND OF THE INVENTION

The sensitivity of an ion analytical instrument, such as a mass spectrometer, depends in part upon the efficiency with which the coupled ion source generates ions from the analytical sample and then delivers those ions to the instrument for analysis.

Efficiency of delivery can be compromised by fragmentation, or decay, of molecular ions prior to analysis. In-source and post-source ion decay is of particular relevance in laser desorption ionization sources, due to the high energies imparted by the laser pulse, and in orthogonal extraction geometries, which require that ions survive at least 2–3 msec before analysis.

One solution to ion fragmentation is to effect collisional cooling of ions before analysis.

Collisional cooling in the first quadrupole ion guide of an orthogonal extraction QqTOF mass spectrometer has been described, both with an electrospray ion source and a laser desorption ionization (LDI) source. See, e.g., WO 99/30351 and Loboda et al., Rapid Communic. Mass Spectrom. 14:1047–1057 (2000).

Collisional cooling earlier in the ion trajectory, within the ion source itself, has also been described.

WO 00/77822, for example, describes a matrix-assisted laser desorption ionization (MALDI) source having a static pressure in the range of 0.1 to 10 torr; the rapid in-source collisional cooling is said to improve the stability of the produced ions. EP 0964427 describes a static ambient pressure MALDI apparatus.

U.S. Pat. No. 6,515,280 (Baykut) describes a MALDI source in which a gas pulse is introduced exactly at the point of laser desorption in synchrony with the laser pulse; the transient pressure increase is said to effect immediate in-source collisional cooling. U.S. patent application Ser. No. 2003/0098413 (Weinberger et al.) describes a laser desorption ionization source in which cooling gas is introduced at the laser-interrogated surface of the LDI probe. In contrast to the device of Baykut, in which the gas introduced at the laser desorption probe surface is in free communication with a subsequent multipole ion guide, the laser desorption probe in Weinberger et al. is communicably segregated from the first multipole ion guide of the analytical instrument.

Although collisional cooling is reported to improve ion stability in each of these various devices, the gas flow fields are nonoptimal through most parts of these devices, compromising the collection, collimation and output of ions.

In the high pressure MALDI sources, for example, gas resting statically in front of the sample, with no means present for facilitating momentum transfer, can lead to ion loss. In devices in which gas is dynamically introduced at the probe surface, gas introduction is effected through asymmetrically arranged channels, giving rise to asymmetrical collisional forces. And in devices in which ions are injected essentially immediately into RF multipoles, with collisional cooling to be effected within the multipole, most ions are exposed to very high electric field strengths, giving rise to additional initial heating.

Thus, there is a need in the art for ion sources, particularly laser desorption ionization sources, that both effect rapid collisional cooling and in which the gas flow fields are configured throughout the device to optimize ion delivery to an ion analytical instrument to which the source is operably coupled.

SUMMARY OF THE INVENTION

The present invention satisfies these and other needs in the art by providing apparatus and methods in which controlled superposition of gas flow fields and electrostatic fields within an ion source effects rapid collisional cooling with improved collection, collimation, and output of ions. The high efficiency injection of unfragmented ions into ion analytical instruments to which the source may be operably coupled can increase significantly the sensitivity of the analytical apparatus.

In a first aspect, the invention provides a device for outputting ions, an ion source device.

The device comprises a first housing and a second housing. The first housing comprises at least one pneumatic element that segregates the space within the first housing into a gas reservoir and an ion expansion chamber, the gas reservoir being in axisymmetric gas communication with the ion expansion chamber and in gas communication with the exterior of the first housing. The second housing comprises at least one pneumatic element that segregates the space within the second housing into an axial trajectory region and a gas sink region, the gas sink region being in axisymmetric gas communication with the axial trajectory region and in gas communication with the exterior of the second housing. The first housing expansion chamber is axially aligned with and in gas and ion communication with the second housing axial trajectory region; the second housing axial trajectory region is in axial alignment with and in ion communication with an ion outlet of the device.

Ions introduced into or generated within the ion expansion chamber are guided, during operation of the device, along the device axis from the expansion chamber through the axial trajectory region to the ion outlet predominantly by pneumatic fields in the first housing and predominantly by electrostatic fields in the second housing.

In typical embodiments, the first housing comprises a plurality of pneumatic elements that segregate the space within the first housing into a gas reservoir and an ion expansion chamber, the gas reservoir being in axisymmetric gas communication with the ion expansion chamber and in gas communication with the exterior of the first housing. Similarly, the second housing typically comprises a plurality of pneumatic elements that segregate the space within the second housing into an axial trajectory region and a gas sink region, the gas sink region being in axisymmetric gas communication with the axial trajectory region and in gas communication with the exterior of the second housing.

In order to generate superposed pneumatic and electrostatic fields in a first portion of the ion trajectory, the first housing typically, but optionally, further comprises at least one electrically conductive element; often at least a portion of at least one of the first housing pneumatic elements is electrically conductive. In some embodiments, at least a portion of a plurality of the first housing pneumatic elements is electrically conductive. In a subset of these embodiments, each of the plurality of first housing pneumatic elements is electrically conductive. The first housing electrically conductive elements, if present, are capable of creating an electrostatic field that is capable of affecting ion trajectory in the expansion chamber.

In order to generate superposed pneumatic and electrostatic fields in a second portion of the ion trajectory, the second housing further comprises, in most embodiments, at least one electrically conductive element.

Typically, at least a portion of at least one of the second housing pneumatic elements is electrically conductive. Often, at least a portion of a plurality of the second housing pneumatic elements is electrically conductive. In a subset of these latter embodiments, each of the plurality of second housing pneumatic elements is electrically conductive. The second housing electrically conductive elements, when present, are capable of creating an electrostatic field capable of guiding ions axially through the axial trajectory region to a device outlet that communicates the axial trajectory region with the exterior of the second housing.

The ion source device of the present invention typically includes means for introducing ions into or generating ions within the expansion chamber. The means can, for example, comprise engagement means or guides for a laser desorption ionization probe upon which an analytical sample may be disposed, the engagement means being capable of positioning a laser desorption ionization probe so as to display at least one surface thereof to the expansion chamber. In some of these embodiments, the probe engagement means is in physical and electrical contiguity to an electrically conductive element. The engagement means may include a probe holder, or other suitable device known in the art.

In addition, the first housing comprises at least one symmetrically disposed gas inlet, typically a plurality of separately disposed gas inlets, that communicate the gas reservoir with the exterior of the first housing. The gas inlet(s) are so shaped and so disposed that the gas pressure inside the gas reservoir is, for the most part, spatially constant, and on average only negligible gas flow speeds occur inside the gas reservoir as compared to gas flow speeds in the expansion chamber. In some embodiments, for example, the gas inlets comprise means to baffle inward streaming gas flow to facilitate the achievement of such pressure and flow characteristics.

Analogously, the second housing comprises at least one, typically a plurality of, symmetrically disposed gas outlets that communicate the gas sink region with the exterior of the second housing.

In some embodiments, one or two completely open sides of the second housing may act as the gas outlets.

In various embodiments, the second housing further comprises additional gas flow guiding means (pneumatic elements) which help maintain axisymmetrically outwardly directed gas flow out of the sink region, although at some point during the spatial transition from the gas sink region to the exterior of the second housing, spatial symmetry may be broken.

Typically, the collective gas flow resistance of the gas outlets is lower than the collective gas flow resistance of the gas inlets. In some embodiments, the plurality of gas outlets are communicably connected to means, disposed outside the second housing, for adjusting outward gas flow. In some embodiments, the plurality of gas inlets are communicably connected to means, disposed outside the first housing, for adjusting inward gas flow.

In certain embodiments, one or more of the at least one first housing pneumatic elements is so shaped and so disposed that maximal constriction to axisymmetric gas flow between the gas reservoir and expansion chamber is located proximal to the expansion chamber.

The gas communication between the gas reservoir and expansion chamber can be either continuously or periodically axisymmetric.

The first and second housings can be separately constructed, and sealingly engaged, or of integral construction.

In some embodiments, the ion source device can be operably coupled to an ion analytical instrument. In some embodiments, the ion source device is so coupled to the analytical instrument as to permit gas to be evacuated through the second housing gas outlets from the ion analytical instrument's ion source-proximal region, such as from a multipole in the instrument's ion-source proximal region.

The present invention further provides, in another aspect, an ion source device. The device comprises ion generating means, first ion guidance means, and second ion guidance means. The first ion guidance means are configured to establish electrostatic fields and ion-guiding pneumatic fields, the ion-guiding pneumatic fields predominating over electrostatic fields during use; the second ion guidance means are configured to establish ion-guiding electrostatic fields and pneumatic fields, the ion-guiding electrostatic fields predominating over pneumatic fields during use.

During operation, ions generated by the ion generating means are guided by the pneumatically dominant first ion guidance means and then by the electrostatically dominant second ion guidance means along the device axis to a device outlet.

The first ion guidance means is typically disposed in a first housing, the second ion guidance means in a second housing, the first housing being in axial ion and gas flow communication with the second housing. As noted above, and further described herein below, the first and second housings can be of integral construction.

In some embodiments, the first ion guidance means comprises at least one electropneumatic element, the at least one electropneumatic element segregating the space within the first housing into a gas reservoir and an ion expansion chamber, the gas reservoir being in axisymmetric gas communication with the ion expansion chamber. In some of these embodiments, the first ion guidance means comprises a plurality of electropneumatic elements, the plurality of electropneumatic elements segregating the space within the first housing into a gas reservoir and an ion expansion chamber, the gas reservoir being in axisymmetric gas communication with the ion expansion chamber.

In some embodiments, at least one of the electropneumatic elements is so shaped and so disposed within the first housing as to create radially inwardly-directed axisymmetric gas flow when the gas reservoir is at a higher pressure than the expansion chamber. In a subset of these embodiments, each of the electropneumatic elements is so shaped and so disposed within the first housing as to create radially inwardly-directed axisymmetric gas flow when the gas reservoir is at a higher pressure than the expansion chamber.

In certain embodiments, at least one of the electropneumatic elements is so shaped and so disposed that gas flowing radially inwardly from the gas reservoir to the expansion chamber encounters maximal constriction axisymmetrically proximal to the expansion chamber.

In some embodiments, the second ion guidance means comprises at least one electropneumatic element, the at least one electropneumatic element segregating the space within the second housing into an axial trajectory region and a gas sink region, the axial trajectory region being in axisymmetric gas communication with the gas sink region. In a subset of these embodiments, the second ion guidance means comprises a plurality of electropneumatic elements, the plurality of electropneumatic elements segregating the space within the second housing into an axial trajectory region and a gas sink region, the axial trajectory region being in axisymmetric gas communication with the gas sink region.

At least one, often each of a plurality, of the electropneumatic elements is so shaped and so disposed within the second housing as to create radially outward-directed axisymmetric gas flow when the axial trajectory region is at a higher pressure than the gas sink region. In some embodiments, the second ion guidance means further comprises gas flow guiding means (pneumatic elements) which help maintain axisymmetrically outwardly directed gas flow out of the sink region, although at some point during the spatial transition from the gas sink region to the exterior of the second housing spatial symmetry may be broken.

The first housing typically comprises at least one, typically a plurality of, symmetrically disposed gas inlets that communicate the gas reservoir with the exterior of the first housing, and the second housing typically comprises at least one large gas outlet, typically a plurality of gas outlets, that communicate the gas sink region with the exterior of the second housing, with the collective gas flow resistance of the second housing gas outlets being lower than the collective gas flow resistance of the first housing gas inlets.

In some embodiments, the means for introducing or generating ions acts to generate ions within the expansion chamber. Such ion generating means include, in some embodiments, laser desorption ionization means.

The laser desorption ionization means can comprise laser desorption ionization probe engagement means, the engagement means being capable of positioning a laser desorption ionization probe so as to display at least one surface thereof to the expansion chamber. In some of these embodiments, the probe engagement means is in electrical contiguity with an electrically conductive element within the first housing.

In some laser desorption ionization means, the laser desorption ionization means can further comprise a mirror that directs laser light to the surface of a laser desorption ionization probe substantially along the device axis. This mirror may also allow observation of the sample, such as by video or other optical systems. Alternatively, the laser desorption ionization means may include a first mirror that directs laser light to the probe surface, and may further include one or more additional mirrors that may be used for video or optical observation of the sample on the probe.

In a further aspect, the invention provides analytical apparatus, comprising an ion source device according to the present invention, operably coupled to an ion analytical instrument.

The ion analytical instrument can, in some embodiments, comprise at least one multipole radio-frequency (RF) ion guide, such as a quadrupole ion guide. In some of these embodiments, the operative coupling of the ion source device to the ion analytical instrument permits the ion source device to draw gas proximally outward from the RF multipole during use.

The ion analytical instrument can usefully comprise at least one mass analyzer, and even a plurality of mass analyzers.

In another aspect, the invention provides methods of increasing the collimated output of ions from an ion source device, and thus methods of increasing the sensitivity of ion analytical instruments to which such ion source devices may optionally be operably coupled.

The methods comprise guiding ions introduced into or generated within the source along the device axis to an ion source outlet using superposed electrostatic and axisymmetric pneumatic fields. Ion-guiding pneumatic fields predominate in their effects on ion motion over electrostatic fields in a first portion of the ion trajectory and ion-guiding electrostatic fields predominate in their effects on ion motion over pneumatic fields in a second portion of the ion trajectory.

In typical embodiments, the pneumatic fields are generated by establishing radially-inward axisymmetric and radially-outward axisymmetric gas flows in axial succession.

In such embodiments, the ion source device can usefully be an ion source device of the present invention.

In some of these embodiments, the magnitude of the gas flows may be controlled in part by controlling gas flows into the gas reservoir, and/or by controlling gas flows out of the gas sink region. In some embodiments, controlling gas flows out of the gas sink region comprises controlling outwardly directed pumping of gas from the gas sink region.

In embodiments of the methods of this aspect of the invention, electrostatic fields are generated by applying an electrical potential to each of a plurality of electrically conductive elements in the ion source device.

In some embodiments, the potential applied to at least one of the plurality of electrically conductive elements changes, typically under computer control, between the time of ion introduction into or generation within the device and ion output from the ion source device. In a subset of these embodiments, the potential applied to a plurality of electrically conductive elements changes between the time of ion introduction into or generation within the device and ion output from the ion source device.

Such change in potential can be used to. facilitate ion focusing and guidance. Such change in potential can also be used to facilitate injection of ions into an RF multipole of an analytical instrument that is optionally coupled to the ion source device. In the latter case, the potential applied to at least one of the plurality of the electrically conductive elements may be ramped coordinately with AC potential stepping of an RF multipole of an ion analytical instrument to which the source is operably coupled.

The methods of the present invention may further comprise a subsequent step of performing at least one analysis on at least one species of ion output from the ion source device. For example, the analysis may comprise determining the mass to charge ratio of at least one ion species.

The methods of the present invention may, other embodiments, further comprise the subsequent steps of: selecting at least one ion species output from the ion source device; fragmenting the at least one selected ion species; and performing at least one analysis on at least one product ion resulting from fragmenting the at least one selected ion.

The analysis may, for example, be determining the mass to charge ratio of the at least one product ion, or performing a complete product ion scan.

The methods of the present invention may further comprise, before the step of guiding ions to the ion source device outlet, the step of: introducing ions into or generating ions within the ion source device.

Introducing or generating ions may comprise, in certain embodiments, generating ions by laser desorption ionization of an analytical sample. In certain of these embodiments, the analytical sample may comprise proteins, and the ions to be guided are ions generated from the proteins. In such embodiments, the methods may further comprise the antecedent step, before generating ions, of capturing proteins from an inhomogeneous mixture on a surface of a laser desorption ionization probe.

BRIEF DESCRIPTION OF THE DRAWINGS

These and other objects and advantages of the present invention will be apparent upon consideration of the following detailed description, taken in conjunction with the accompanying drawings and figures, in which like graphical representations refer to like structures or items throughout, and in which.

DETAILED DESCRIPTION

The apparatus and methods of the present invention rely upon the controlled superposition of gas flow fields and electrostatic fields within an ion source to effect rapid collisional cooling with improved collection, collimation, and output of ions. The high efficiency injection of unfragmented ions into ion analytical instruments to which the source may be operably coupled can significantly increase the sensitivity of the instrument.

In a first aspect, the invention provides an ion source device.

In the first region of the ion source, radially-inward axisymmetric gas flow creates ion-guiding gas flow (pneumatic) fields that predominate in their effects on ion motion over electrostatic fields during operation of the device. This collision-dominated first region effects rapid collisional cooling as well as ion capture and trajectory collimation. In the second region of the source, ion-guiding electrostatic fields predominate in their effects on ion motion over gas flow fields created by radially-outward axisymmetric gas flow during use. In this electrostatically-dominated second region, ions are separated from the gas and electrostatically guided toward subsequent ion analytical instruments; the electrostatic fields are such that negligible collisional heating occurs.

Figure 1A:
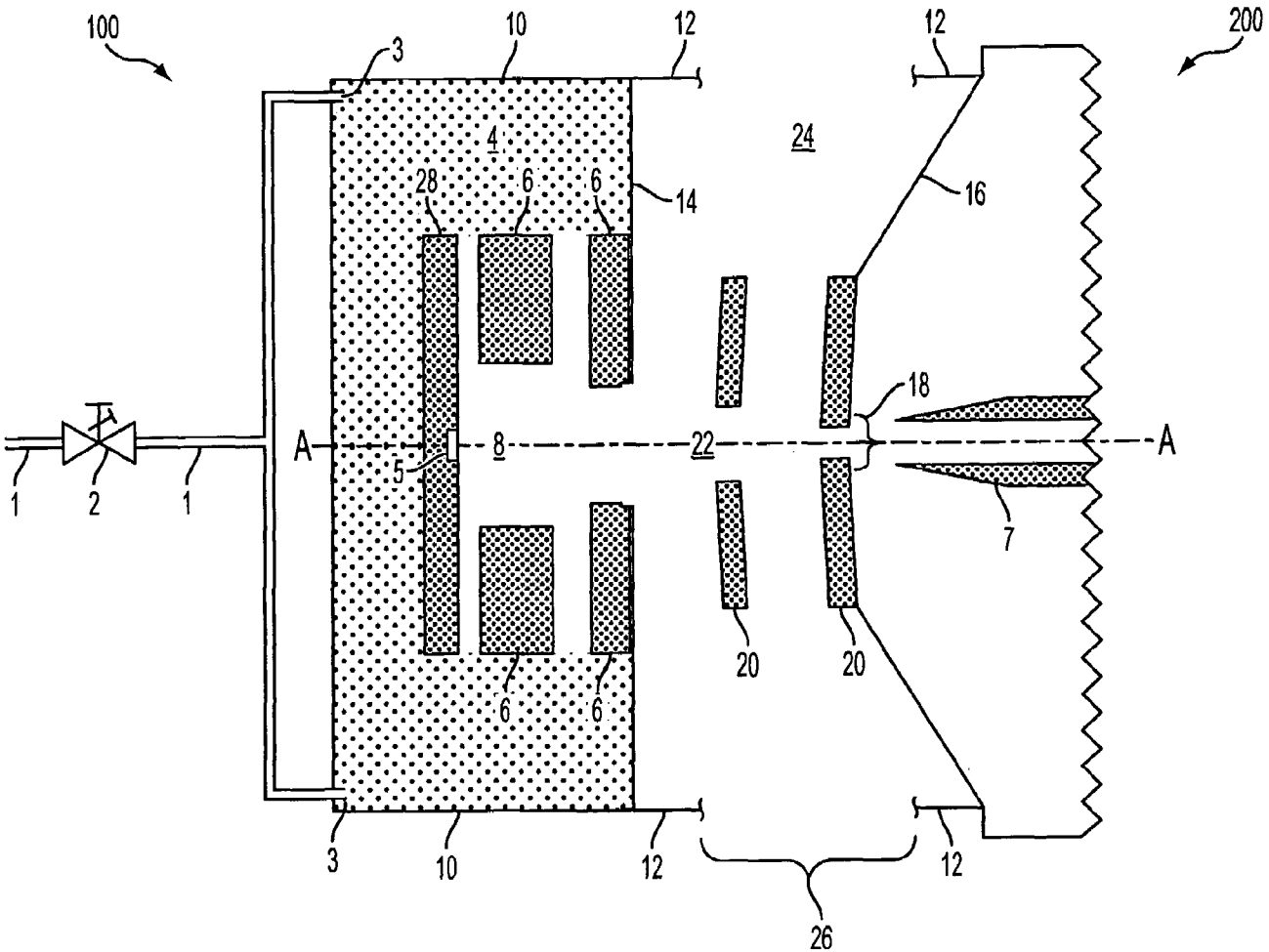
FIG. 1A is a schematic axial cross-section of an embodiment of an ion source device according to the present invention, operably engaged to the initial portion of a multipole-containing ion analytical instrument.

FIG. 1A is a schematic cross-section of an embodiment of an ion source device according to the present invention. The cross-section is taken along device axis A—A, defined by ion introduction or generation means 5 on the proximal end and ion outlet 18 on the distal end of ion source 100. In FIG. 1A, ion source 100 is shown operably engaged at its distal end to the proximal end of analytical instrument 200, shown in partial cross-section, and axis A—A is shown extending into first multipole 7 of analytical instrument 200.

Ion source 100 comprises first housing 10 and second housing 12. First housing 10 is sealingly engaged to second housing 12 through interface partition 14, which partition provides, however, for axial communication of gas and ions between first and second housings, as further described below. First housing 10 and second housing 12 can be separately constructed and subsequently fused, with either or both contributing to interface partition 14, or can be of integral construction.

First housing 10 comprises at least one pneumatic element 6 that segregates the space within first housing 10 into gas reservoir 4 and ion expansion chamber 8. In typical embodiments, first housing 10 comprises a plurality of pneumatic elements 6, the plurality of pneumatic elements segregating the space within the first housing into gas reservoir 4 and ion expansion chamber 8.

The one or more pneumatic elements 6 are so shaped and so disposed within housing 10 as to cause gas reservoir 4 to be in axisymmetric gas communication with ion expansion chamber 8.

First housing 10 further comprises at least one, typically a plurality of, gas inlets 3 that communicate gas reservoir 4 with the exterior of first housing 10. Gas inlets 3 are preferably positioned symmetrically in housing 10; in embodiments in which housing. 10 is cylindrical, gas inlets 3 can usefully be axisymmetrically arranged in housing 10. Symmetrical disposition of gas inlets 3 provides maximum isotropy of gas pressure in gas reservoir 4.

Gas inlets 3 are typically also designed to minimize turbulence at the point of gas entry into gas reservoir 4: in some embodiments, for example, gas inlets 3 are baffled.

Gas present in gas reservoir 4 during use of the ion source is schematized by stippling in FIG. 1A.

Second housing 12 comprises at least one pneumatic element 20 that segregates the space within the second housing into axial trajectory region 22 and gas sink region 24. In typical embodiments, second housing 12 comprises a plurality of pneumatic elements 20, the plurality of pneumatic elements segregating the space within the first housing into axial trajectory region 22 and gas sink region 24. The one or more pneumatic elements 20 are so shaped and so disposed within second housing 12 as to cause axial trajectory region 22 to be in axisymmetric gas communication with gas sink region 24.

Second housing 12 further comprises at least one, typically a plurality of, gas outlets 26 that communicate gas sink region 24 with the exterior of second housing 12. Gas outlets 26 are preferably positioned symmetrically in second housing 12; in embodiments in which housing 12 is cylindrical, gas outlets 26 can usefully be axisymmetrically arranged in housing 12. Symmetrical disposition of gas outlets 26 provides maximum symmetry in radially outward gas flow fields during use.

In various embodiments (not shown in FIG. 1A), the second housing may further comprise additional gas flow guiding means (pneumatic elements) which help maintain axisymmetrically outwardly directed gas flow out of the gas sink region, although at some point during the spatial transition from the gas sink region to the exterior of the second housing, spatial symmetry may be broken.

With continued reference to FIG. 1A, expansion chamber 8 is axially aligned with and in gas and ion communication with axial trajectory region 22. Axial trajectory region 22 is in axial alignment with and in ion communication (and optionally also in gas communication) with ion outlet 18 of device 100. In the embodiment shown in FIG. 1A, axial trajectory region 22 and ion outlet 18 are in axial alignment with multipole 7 of ion analytical instrument 200, with partition 16 and distal-most pneumatic elements 20 forming a sealing engagement with ion analytical instrument 200.

In order to establish electrostatic fields capable of acting upon ions introduced into expansion chamber 8, housing 10 optionally, but typically, comprises at least one electrically conductive element.

In the embodiment shown in FIG. 1A, for example, element 28 can be an electrically conductive element.

Typically, at least a portion of at least one of the pneumatic elements 6 in housing 10 is electrically conductive; the electropneumatic element contributes to both gas flow (i.e., pneumatic) fields and electrostatic fields during use. In the schematized embodiment shown in FIG. 1A, electrically conductive element 28 can also be such an electropneumatic element 6.

In various embodiments, at least a portion of a plurality of pneumatic elements 6 in housing 10 is electrically conductive, the plurality of electropneumatic elements contributing to both pneumatic fields and electrostatic fields during use. In the schematized embodiment shown in FIG. 1A, electrically conductive element 28 can be one of the plurality of such electropneumatic elements 6.

In certain embodiments, all of a plurality of pneumatic elements 6 in housing 10 are electrically conductive, the plurality of electropneumatic elements contributing to both pneumatic fields and electrostatic fields during use. In the schematized embodiment shown in FIG. 1A, electrically conductive element 28 can be one of the plurality of such electropneumatic elements 6.

Analogously, in order to establish electric, typically electrostatic, fields capable of acting upon ions introduced into axial trajectory region 22, and optionally capable of acting upon ions within expansion chamber 8, housing 12 further comprises at least one electrically conductive element.

Typically, at least a portion of at least one of pneumatic elements 20 in housing 12 is electrically conductive; the electropneumatic element contributes to both gas flow (i.e., pneumatic) fields and electrostatic fields during use.

In various embodiments, at least a portion of a plurality of pneumatic elements 20 in housing 12 is electrically conductive, the plurality of electropneumatic elements contributing to both pneumatic fields and electrostatic fields during use.

In certain embodiments, all of a plurality of pneumatic elements 20 in housing 12 is electrically conductive, the plurality of electropneumatic elements contributing to both pneumatic fields and electrostatic fields during use.

In certain embodiments, the potentials applied to the electrically conductive elements of ion source 100 can usefully be ramped coordinately with AC potential stepping of an RF multipole of an ion analytical instrument to which the source is operably coupled, as further described and claimed in the commonly owned patent application Ser. No. 11/063,801 filed concurrently herewith by Andreas Hieke, entitled "Methods And Apparatus For Controlling Ion Current In An Ion Transmission Device" the disclosure of which is incorporated herein by reference in its entirety.

Figure 1B:
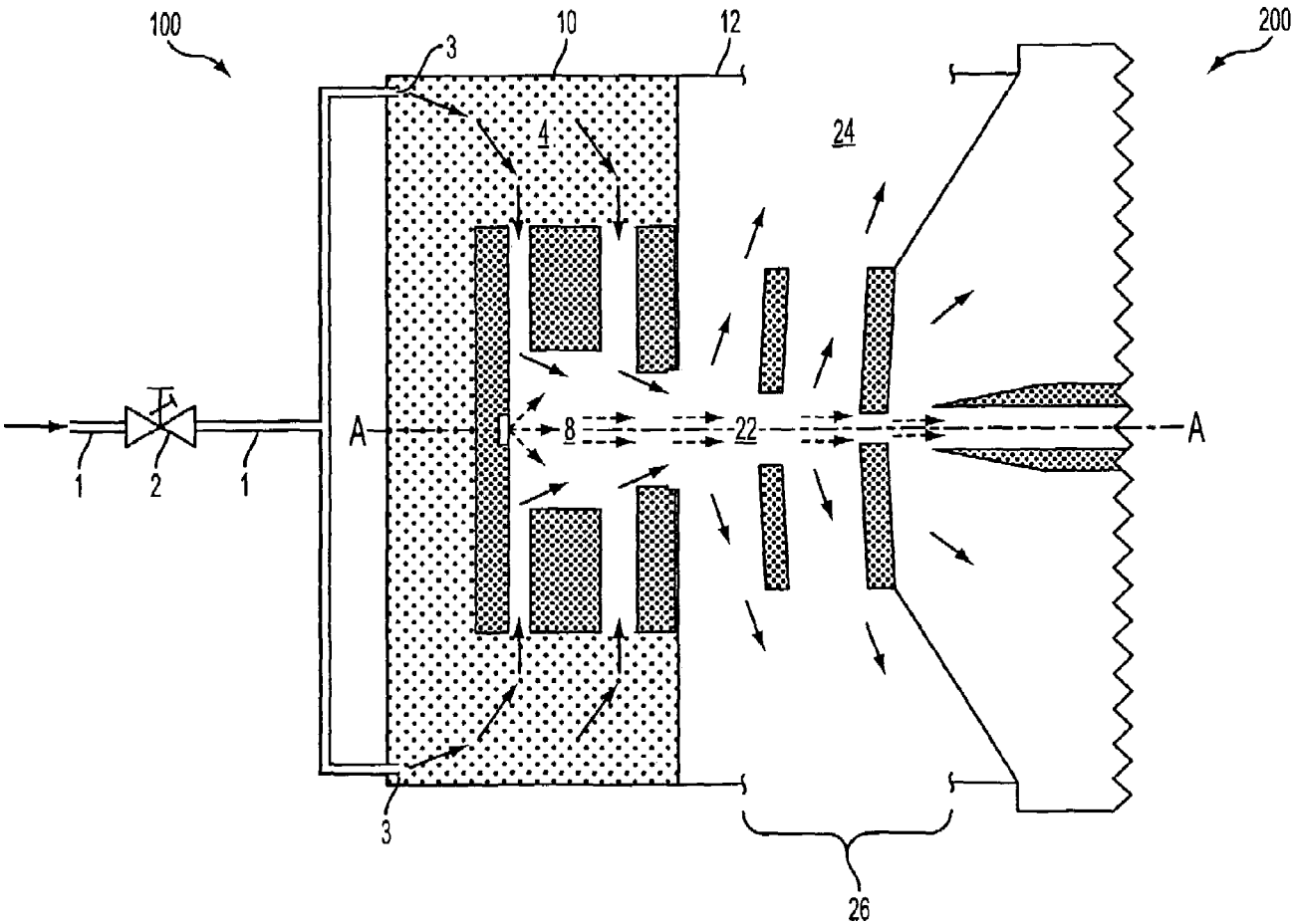
FIG. 1B schematizes exemplary gas flow and ion trajectories during operation of the ion source device of FIG. 1A, with exemplary gas flows shown in solid arrows and exemplary ion trajectories shown in dashed arrows.

FIG. 1B schematizes exemplary gas flow and ion trajectories during operation of the ion source device of FIG. 1A, with exemplary gas flows shown in solid arrows and exemplary ion trajectories shown in dashed arrows.

Gas, from either a dedicated reservoir (not shown) or directly or indirectly from atmosphere, is routed through gas line 1 to gas inlets 3 of first housing 10 by maintaining gas sink region 24 within second housing 12 at lower pressure than gas reservoir 4, as for example by outward pumping at gas outlet 26 of second housing 12.

The gas can usefully be selected, for example, from the group consisting of atmospheric gas, conditioned atmospheric gas, nitrogen, and noble gases, such as argon.

Conditioning of atmospheric gas can include, e.g., removal of moisture using a moisture trap and/or removal of particulates using one or more filters of various porosity.

Usefully, gas line 1 includes one or more flow adjustment means 2, such as one or more throttling valves, disposed between the gas source and gas inlets 3 of housing 10, permitting the resistance to inward gas flow to be adjusted.

Optionally, flow adjustment means 2 may be actively controlled by an electronic feedback system which measures the gas pressure in gas reservoir 4 at one or more points and adjusts the gas flow through line 1 such that the pressure in reservoir 4 is maintained with high accuracy at a constant value, even if operating conditions and or pumping power might fluctuate.

Gas reservoir 4 is maintained at a pressure that is typically subatmospheric, but greater than that in gas sink region 24. As a result, gas flows radially inward between pneumatic (optionally, electropneumatic) elements 6 into expansion chamber 8.

For the most part, the gas pressure inside gas reservoir 4 is spatially constant. On average only negligible gas flow speeds occur inside the gas reservoir as compared to gas flow speeds in the expansion chamber, as shown in the gas flow velocity magnitude contour plot of FIG. 5, further described herein below. In some embodiments, the gas inlets comprise means to baffle inward streaming gas flow to facilitate the achievement of such pressure and flow characteristics.

Figure 4A:
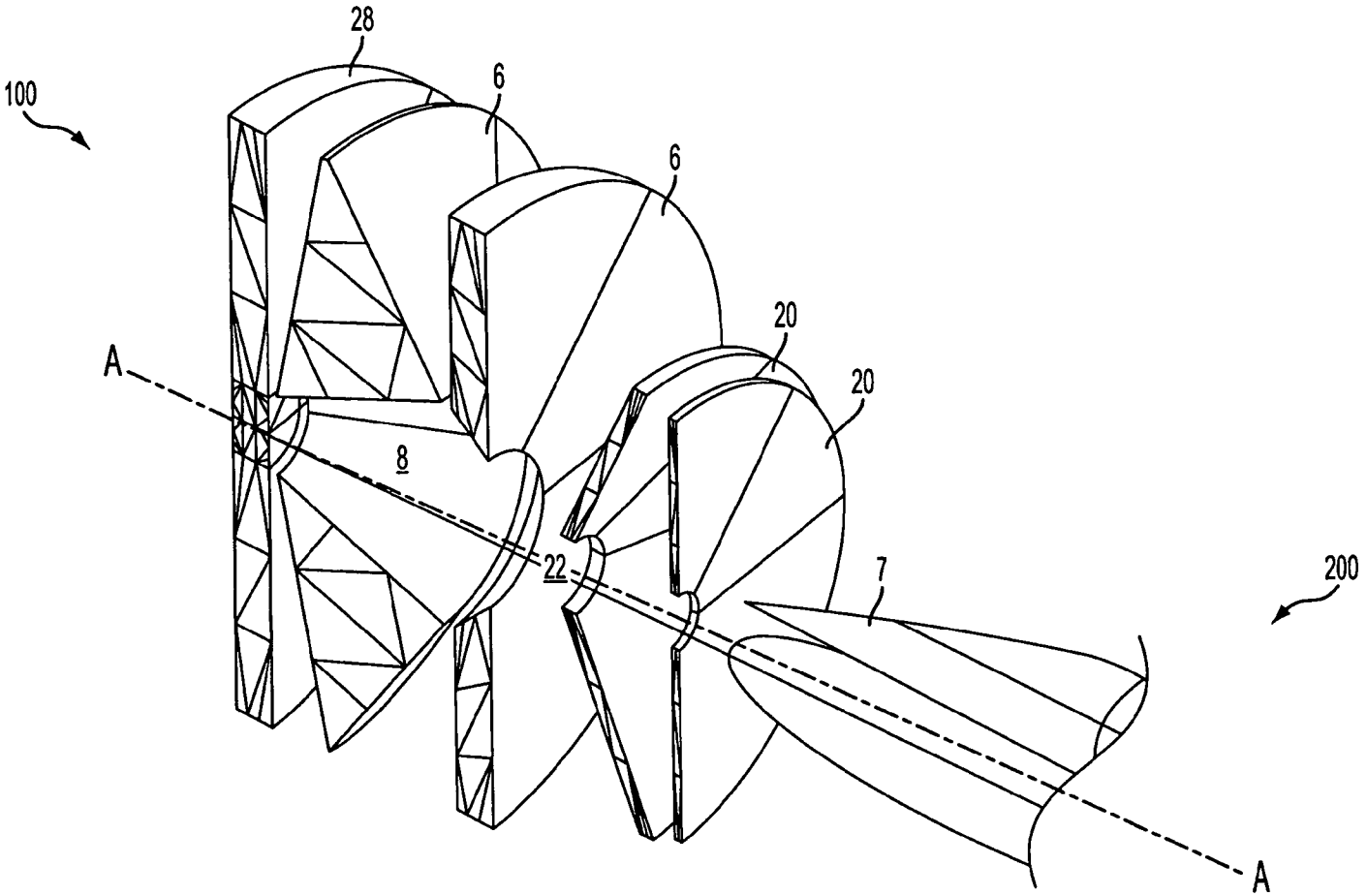
FIG. 4A is a perspective view of an axial cross-section of an embodiment of an ion source device according to the present invention, showing the pneumatic (optionally, electropneumatic) elements in operable alignment but without enclosing housings, and further showing the pneumatic (optionally, electropneumatic) elements in operable alignment with a multipole of an ion analytical instrument.
Figure 4B:
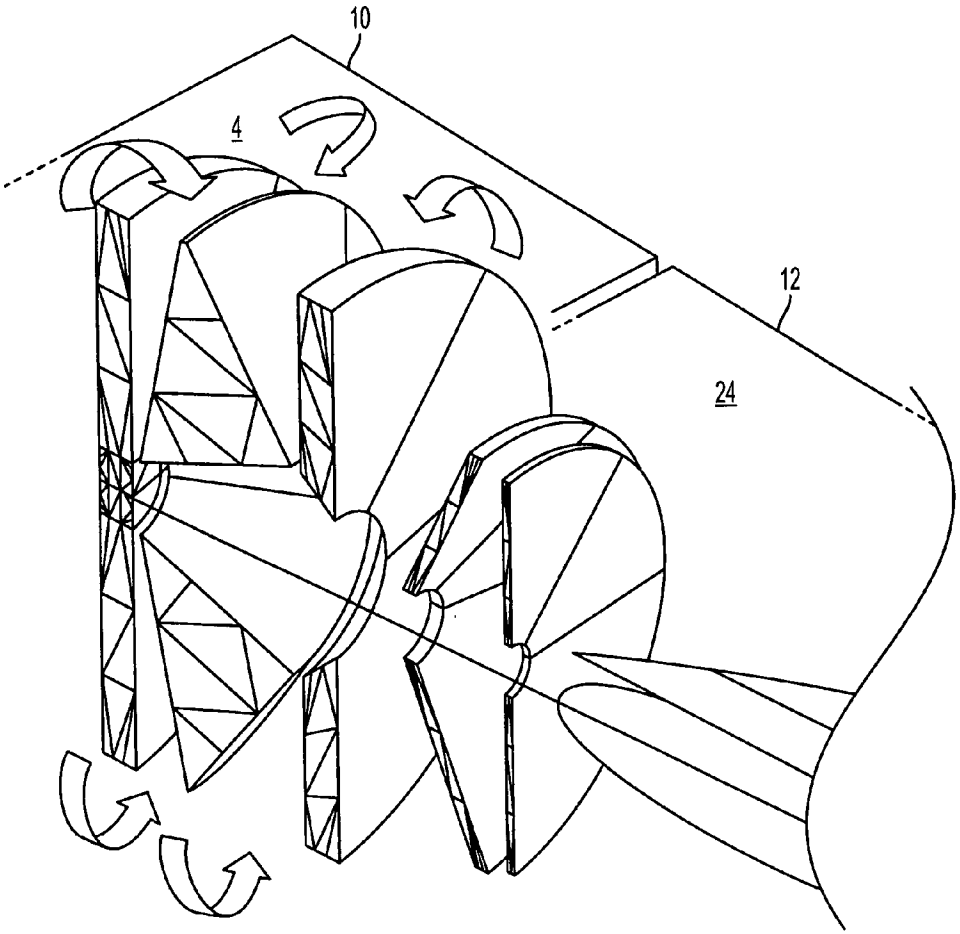
FIG. 4B is a perspective view of an axial cross-section of the pneumatic (optionally, electropneumatic) elements of FIG. 4A, with a portion of the first housing schematized and with stippled arrows schematizing the radially inward axisymmetric gas flow from the gas flow reservoir toward the expansion chamber that occurs within the first housing during use. In this embodiment, the points of maximal constriction to radially inward axisymmetric gas flow are located at the points most proximal to the expansion chamber.

The radially inward axisymmetric flow of gas from gas reservoir 4 into expansion chamber 8 is further illustrated in FIG. 4B, which presents a perspective view of an axial cross-section of device 100 with a portion of first housing 10 and second housing 12 schematized; stippled arrows schematize the radially inward axisymmetric gas flow from the gas flow reservoir toward the expansion chamber within first housing 10.

With reference to FIG. 1B, ion trajectories in expansion chamber 8, exemplified by dashed arrows, are shaped principally by the above-described gas flow fields, which predominate in their effects on ion motion over any electrostatic fields that may also be extant in housing 10 during use.

Gas then flows from expansion chamber 8 into axial trajectory region 22, radially outward axisymmetrically through pneumatic (optionally, electropneumatic) elements 20, through gas sink region 24, and thence through at least one, typically through a plurality of, symmetrically disposed gas outlets 26.

In typical embodiments, the collective gas flow resistance of second housing gas outlets 26 is lower than the collective gas flow resistance of first housing gas inlets 3. In a typical embodiment, the difference in gas flow resistance is accomplished by using outlets having greater collective cross sectional area than the collective cross sectional area of the gas inlets.

In various embodiments, the gas flow through either or both of gas inlet(s) 3 and gas outlet(s) 26 are adjustable during device use.

Although not shown in FIGS. 1A and 1B, gas flow outlets 26 of second housing 12 may, in certain embodiments, be in gas flow communication with means, disposed outside housing 12, for adjusting outward gas flow. Such means include, for example, one or more variable or constant flow resistors, throttling valves, or controllable pumps disposed outside housing 12; the flow adjustment means can be used to set the minimum pressure inside gas sink region 24 and/or to influence the gas flow vector field within housing 12.

Figure 1C:
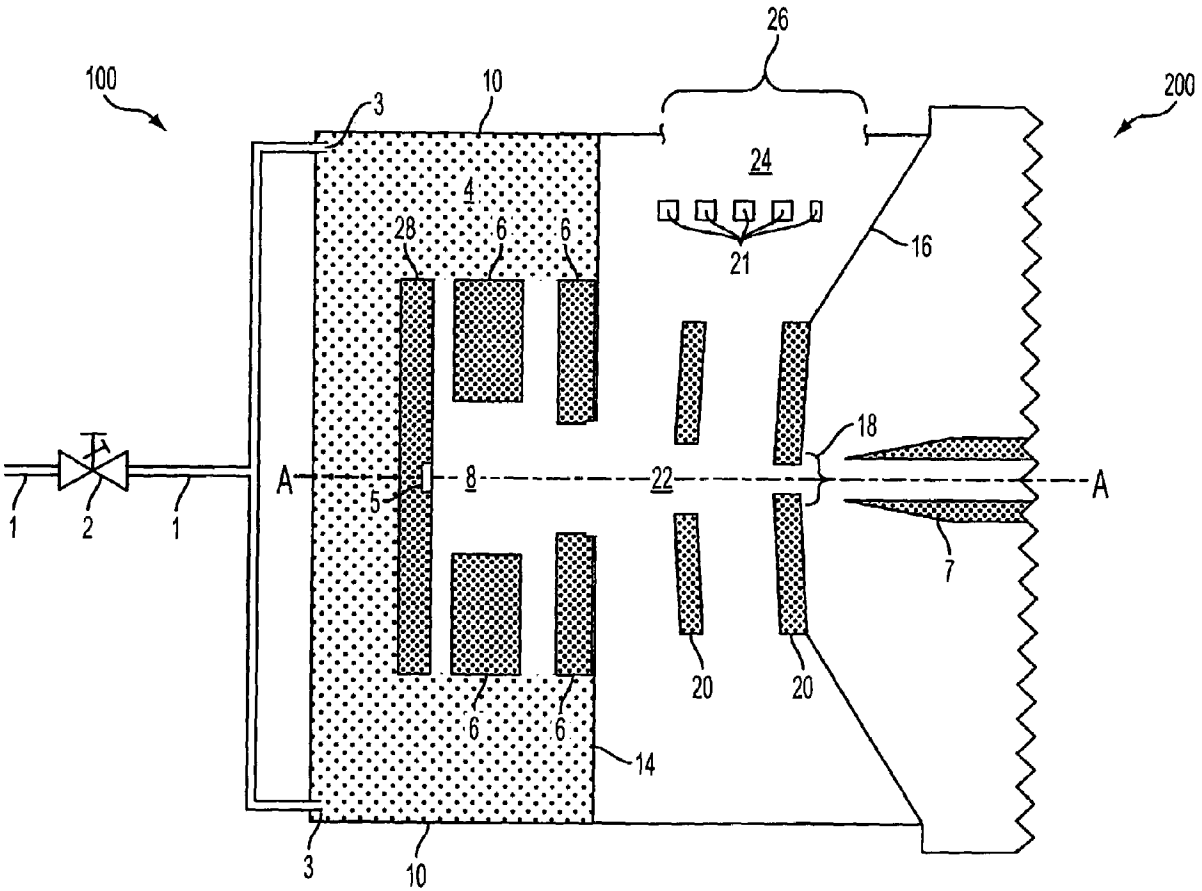
FIG. 1C is a schematic axial cross-section of another embodiment of an ion source device according to the present invention, operably engaged to the initial portion of a multipole-containing ion analytical instrument. In this embodiment, additional pneumatic elements compensate for the asymmetric outward gas flow through a single, asymmetrically disposed, gas outlet.

Furthermore, in various embodiments such as that schematized in FIG. 1C, second housing 12 may comprise additional pneumatic elements 21 that help maintain axisymmetrically outwardly directed gas flow out of gas sink region 24, notwithstanding a break in symmetry from the gas sink region to the exterior of the second housing. For example, in the embodiment of FIG. 1C, a single gas outlet 26 is disposed asymmetrically in second housing 12; notwithstanding the lack of symmetry in gas flow outwards through second housing 12, additional pneumatic elements 21 so baffle outward air flow as to maintain axisymmetric gas flow through most of gas sink region 24.

As exemplified in FIG. 1B, ion trajectories in axial trajectory region 22 are little affected by the radially outward axisymmetric gas flow fields in second housing 12. The radially outward axisymmetric gas flow vectors have little defocusing effect on the ion trajectories in this region because the spatially varying gas pressures are significantly lower than the pressure in expansion chamber 8, and because ion trajectories are dominated in axial trajectory region 22 by electrostatic forces.

Figure 2:
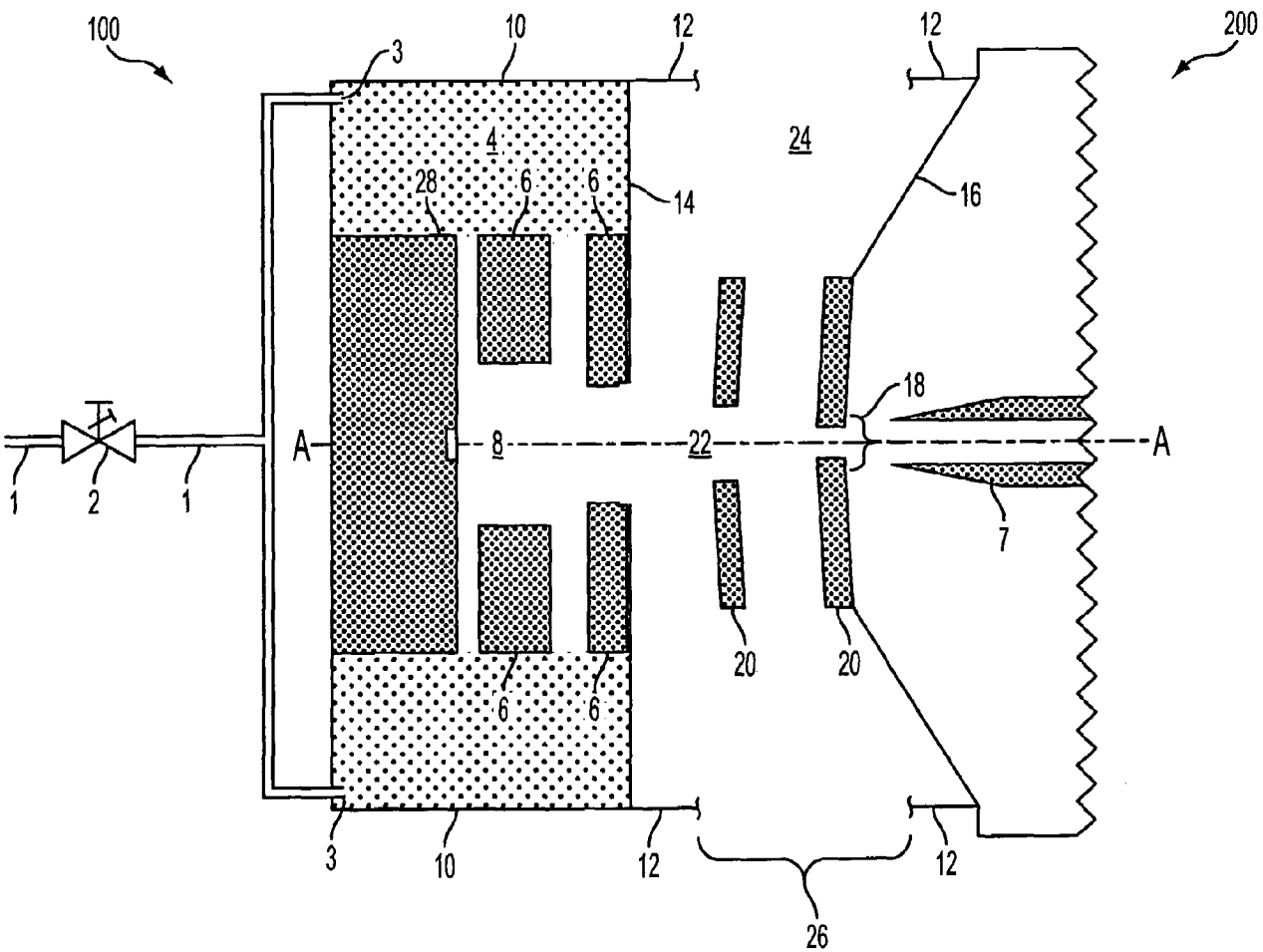
FIG. 2 is a schematic axial cross-section of another embodiment of an ion source device according to the present invention, operably engaged to the initial portion of a multipole-containing ion analytical instrument.

FIG. 2 is a schematic axial cross-section of another embodiment of an ion source device according to the present invention, operably engaged to the initial portion of a multipole-containing ion analytical instrument.

In the embodiment of FIG. 2, element 28 extends proximally into contiguity with housing 10. Gas inlets 3 are, as in the embodiment shown in FIGS. 1A and 1B, symmetrically disposed, maintaining maximum isotropy of gas pressure in gas reservoir 4. As in the embodiment of FIGS. 1A and 1B, pneumatic (optionally, electropneumatic) elements 6 are so shaped and so disposed as to effect radially inward, axisymmetric gas flow from gas reservoir 4 into expansion chamber 8 during use.

Figure 3:
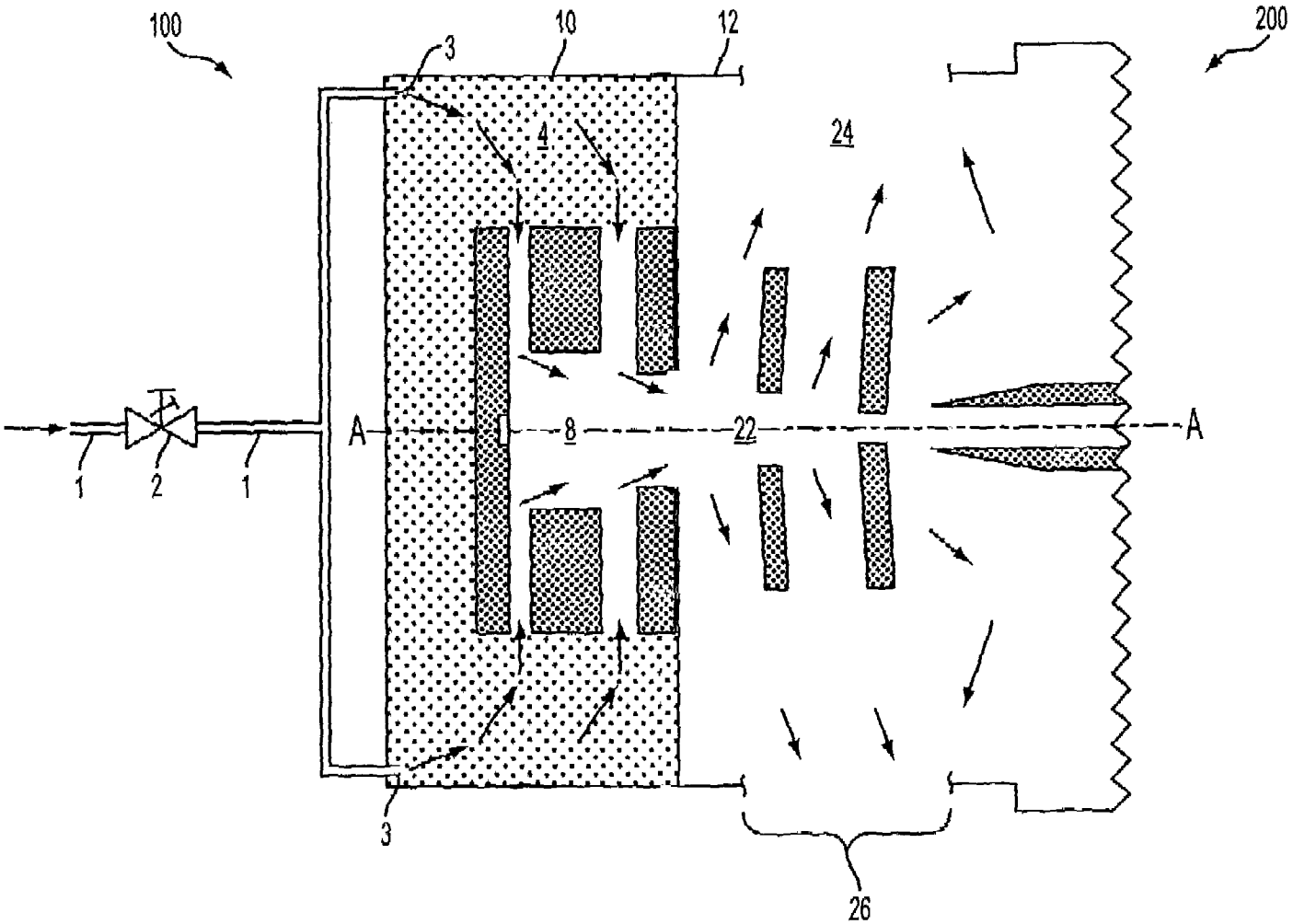
FIG. 3 is a schematic axial cross-section of another embodiment of an ion source device according to the present invention, operably integrated into the initial portion of a multipole-containing ion analytical instrument.

FIG. 3 is a schematic axial cross-section of a further embodiment of an ion source device according to the present invention. In this embodiment, the ion source is coupled to an ion analytical instrument in a geometry that permits gas additionally to be evacuated through gas outlets 26 from the ion analytical instrument's multipole region.

Figure 4C:
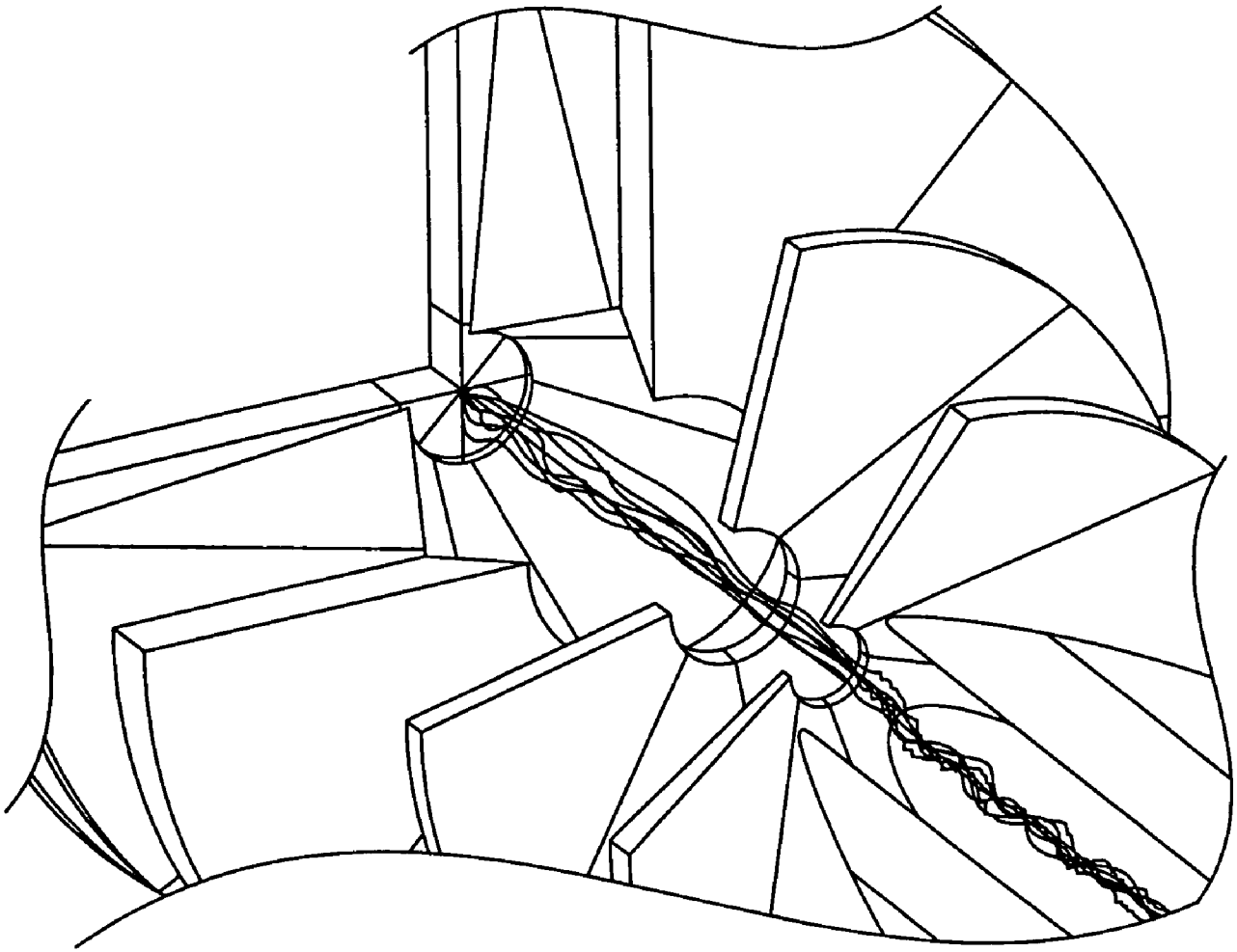
FIG. 4C is a perspective view of an axial cross-section of an embodiment of an ion source device according to the present invention, showing electropneumatic elements in operable alignment with one another and with a multipole of a subsequent ion analytical instrument, and further showing mathematically-modeled ion trajectories.

FIGS. 4A–4C are perspective views of an axial section through embodiments of an ion source according to the present invention. Element 28 (optionally electrically conductive, optionally an electropneumatic element), pneumatic (optionally, electropneumatic) elements 6, and pneumatic (optionally, electropneumatic) elements 20 of ion source device 100 are shown operationally aligned with multipole 7 of ion analytical instrument 200. In FIGS. 4A and 4C, housings 10 and 12 are omitted; in FIG. 4B, a portion of each of housings 10 and 12 is schematized.

As in FIGS. 1A and 1B, FIGS. 4A–4C show: a single element 28, which can optionally be an electrically conductive element 28 or an electropneumatic element 6; two pneumatic (optionally, electropneumatic) elements 6; and two pneumatic (optionally, electropneumatic) elements 20. The number of electrically conductive and pneumatic elements is not critical to the invention, however, and there may be fewer or greater numbers of electrically conductive and pneumatic (optionally, electropneumatic) elements in various embodiments.

In the embodiments of FIGS. 4A–4C, the pneumatic elements (optionally, electropneumatic elements) 6 are so shaped and so disposed that the point of greatest constriction to radially inward axisymmetric gas flow—between element 28 and proximal pneumatic element 6, and also between the proximal and distal pneumatic elements 6—is in immediate proximity to ion expansion chamber 8.

The flow resistance beyond these points of greatest constriction—i.e., within ion expansion chamber 8, axial trajectory region 22, gas sink region 24, and gas outlets 26—is much lower than the flow resistance at the points of closest constriction.

Figure 5:
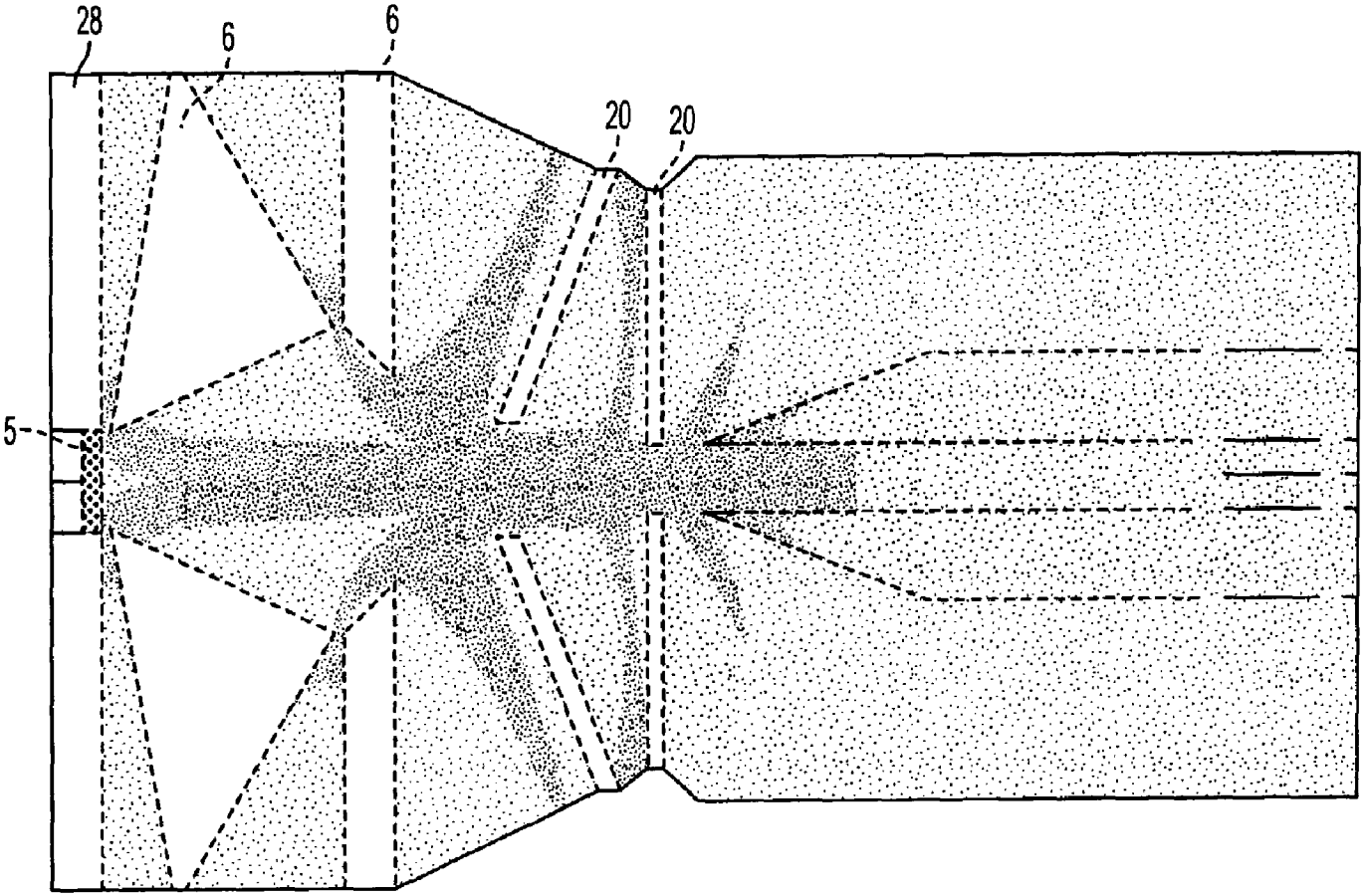
FIG. 5 shows a mathematically modeled contour plot of gas flow velocity magnitude during use of an embodiment of an ion source device according to the present invention.
Figure 6:
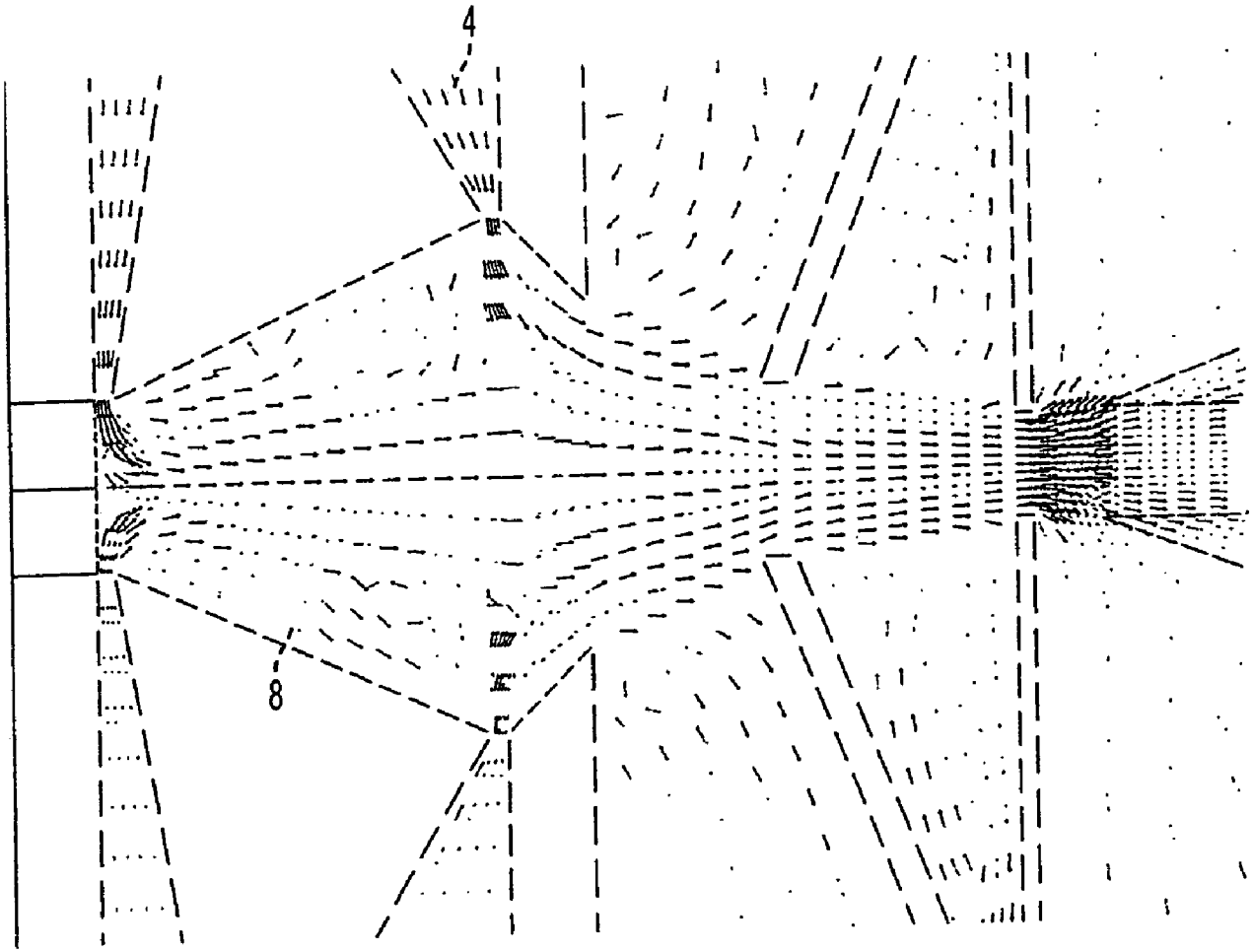
FIG. 6 shows a mathematically modeled vector plot of gas flow velocity during use of an embodiment of an ion source device according to the present invention.

As a result, high gas expansion velocities occur radially inward into expansion chamber 8, as further shown in the simulations shown in FIGS. 5 and 6.

The simulation depicted in FIGS. 5 and 6 (as well as in the others of FIGS. 4C–10) were performed using methods such as those described in the following references, incorporated herein by reference in their entireties: Andreas Hieke, "GEMIOS—a 64-Bit multi-physics Gas and Electromagnetic Ion Optical Simulator", Proceedings of the 51st Conference on Mass Spectrometry and Allied Topics (Jun. 8–12 2003, Montr al, PQ, Canada); Andreas Hieke "Theoretical and Implementational Aspects of an Advanced 3D Gas and Electromagnetic Ion Optical Simulator Interfacing with ANSYS Multiphysics", Proceedings of the International Congress on FEM Technology, pp. 1.6.13 (Nov. 12–14, 2003, Potsdam, Germany); Andreas Hieke, "Development of an Advanced Simulation System for the Analysis of Particle Dynamics in LASER based Protein Ion Sources", Proceedings of the 2004 NSTI Nanotechnology Conference and Trade Show Nanotech 2004 (Mar. 7–11, 2004, Boston, Mass., U.S.A.).

FIG. 5 is an axial section of a mathematically modeled contour plot of gas flow velocity magnitudes during use of an embodiment of an ion source device according to the present invention that is similar to the embodiments schematized in FIGS. 4A–4C; darker regions indicate higher velocity gas flow. FIG. 6 is an axial section of a mathematically modeled vector plot of gas flow velocity during use of an embodiment of an ion source device similar to the embodiments schematized in FIGS. 4A–4C.

The pressure in gas reservoir 4 is chosen such that, for a given resistance to radially inward, axisymmetric gas flow, the pressure and velocity distribution in expansion chamber 8 pneumatically collects and cools effectively all of the ions ejected from the ion introduction or generation means, such as ions present in plume ejected from a laser desorption ionization probe.

Figure 7:
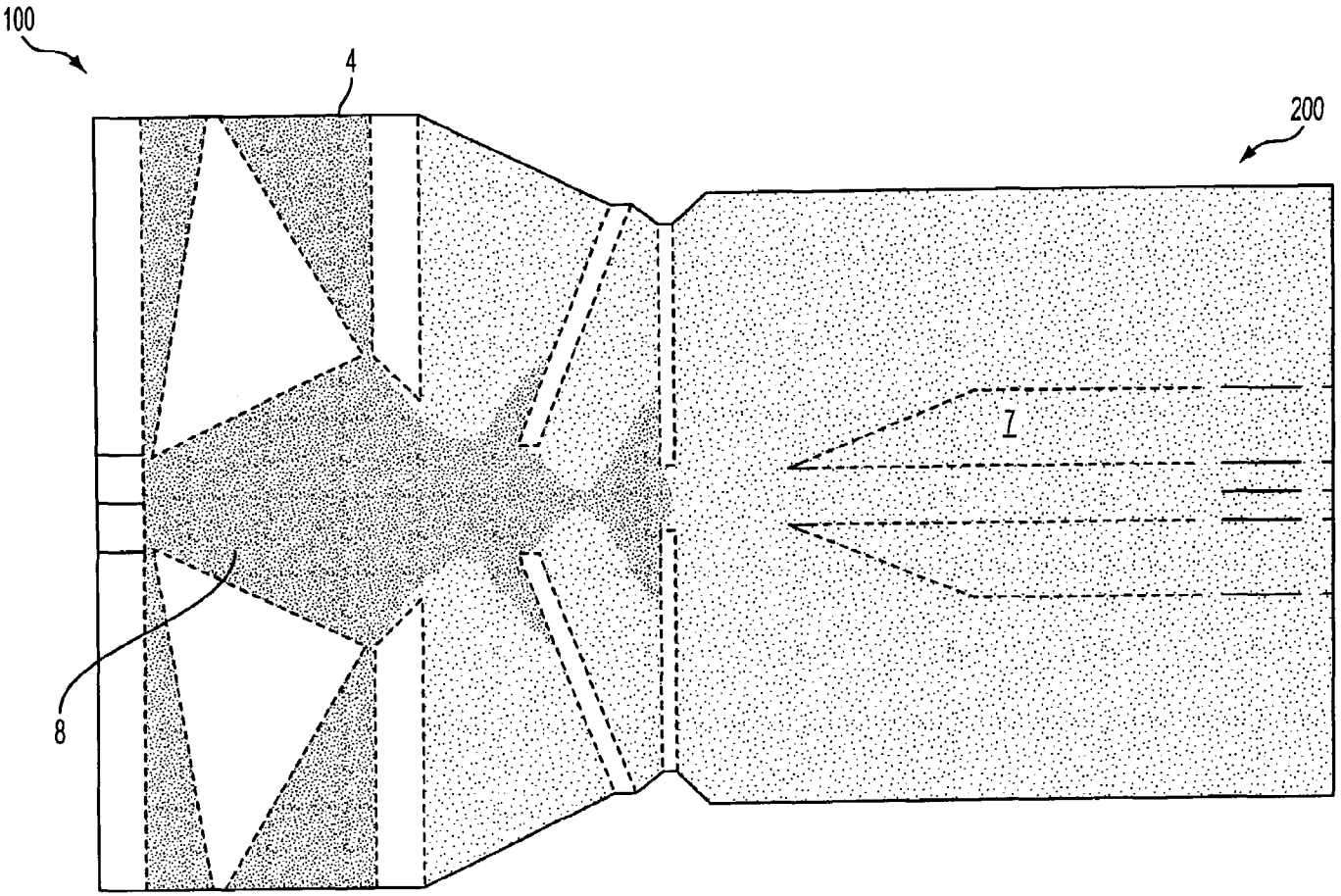
FIG. 7 shows a mathematically modeled contour plot of the distribution of gas pressure during use of an embodiment of an ion source device according to the present invention.

FIG. 7 shows a mathematically modeled contour plot of the distribution of gas pressures during use of an embodiment of an ion source device according to the present invention similar to the embodiments schematized in FIGS. 4A–4C; higher pressures are in darker shades. As can be seen, the pressure throughout gas reservoir 4 is essentially constant, with a dramatic drop in pressure occurring upon entry to expansion chamber 8. As can also be seen, pressures within ion source 100 are effectively decoupled from that in RF multipole 7 of ion analytical instrument 200.

Figure 8:
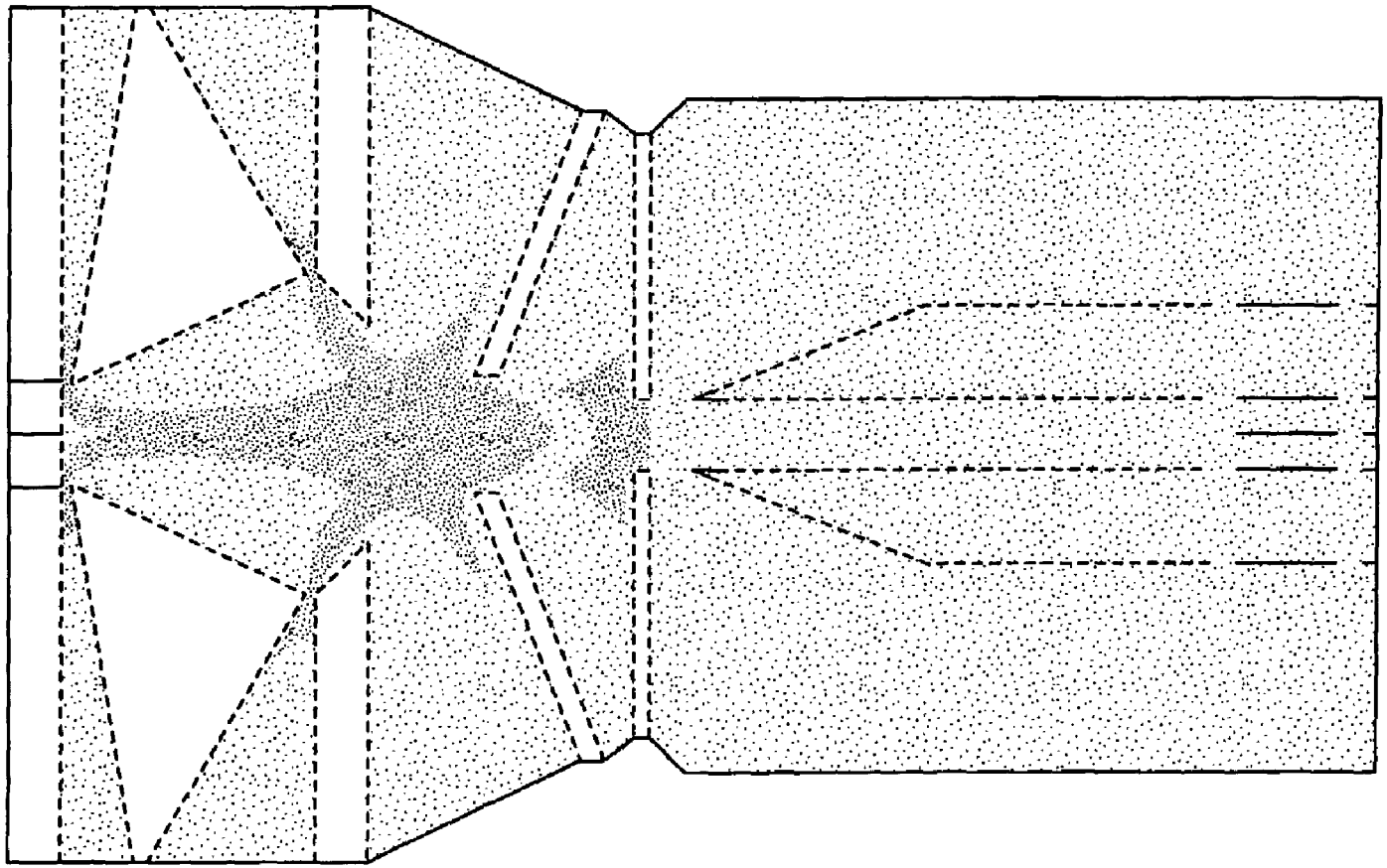
FIG. 8 shows a mathematically modeled contour plot of the mathematical product of the gas flow velocity magnitude and gas pressure, demonstrating predominance of collisional effects in the first housing during use of an embodiment of an ion source device according to the present invention.

FIG. 8 shows a contour plot of the mathematical product of the modeled gas flow velocity magnitude and gas pressures—providing a measure of collisional effects—in an embodiment of an ion source device according to the present invention similar to the embodiments shown in FIGS. 4A–4C. The contour plot demonstrates the predominance of collisional effects in the pneumatically dominant first phase of ion guidance, confirming that rapid collisional cooling is effected in ion source devices according to the present invention.

Figure 9:
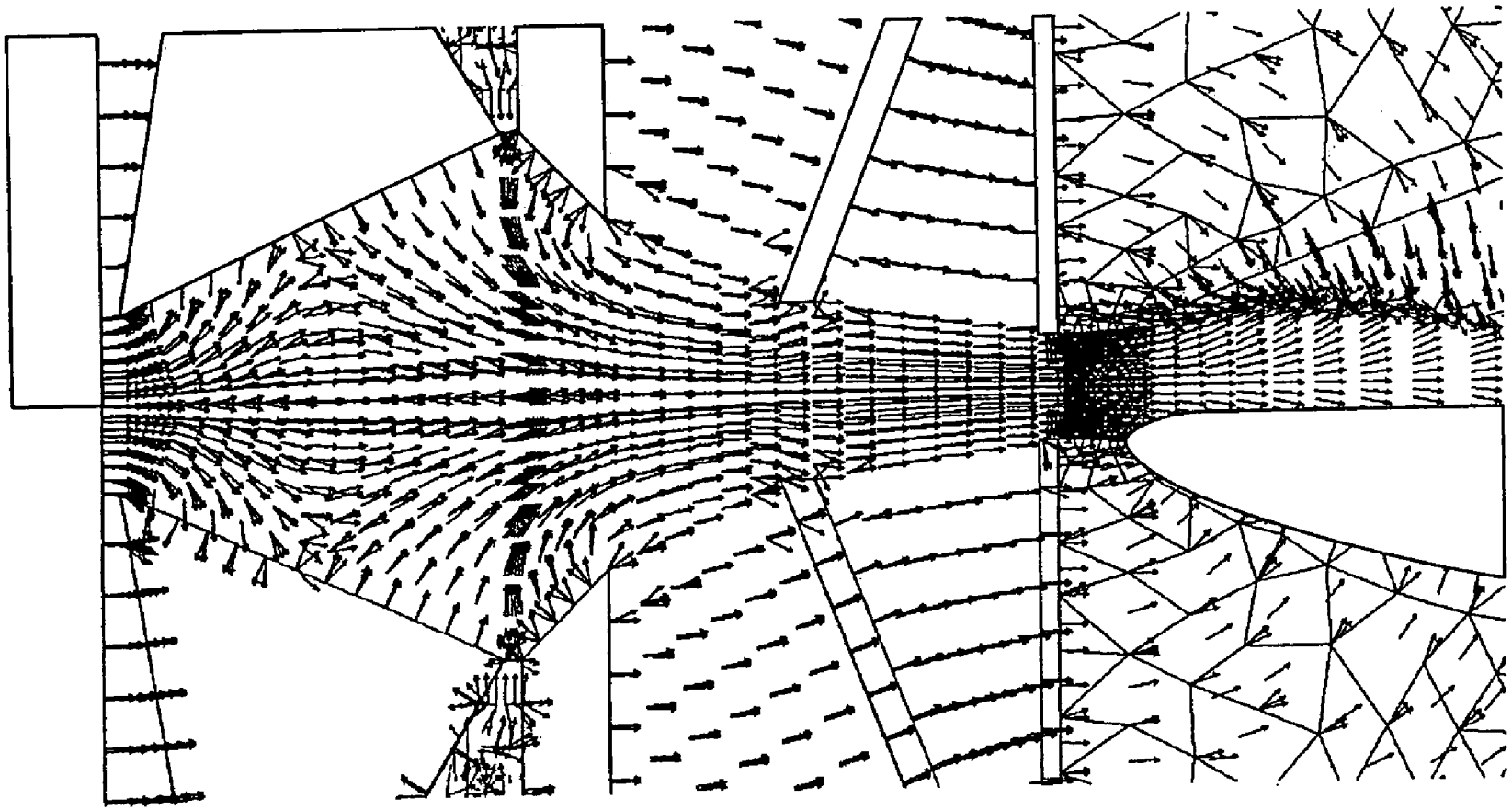
FIG. 9 shows a mathematically modeled vector plot of the electric field at one set of potentials during use of an embodiment of an ion source device according to the present invention.

FIG. 9 shows a mathematically-modeled vector plot of the electrostatic fields during operation of an embodiment of an ion source device of the present invention that is similar to the embodiments shown in FIGS. 4A–4C, at one set of electrical potentials.

Figure 10:
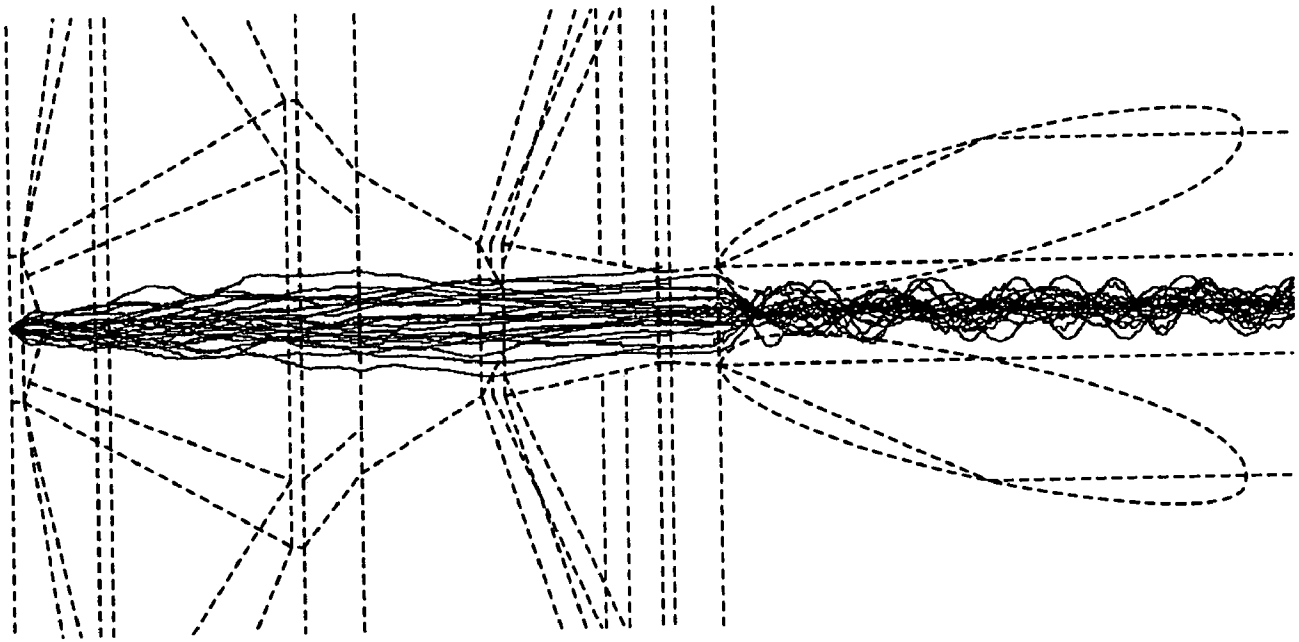
FIG. 10 shows mathematically modeled ion trajectories for one set of operating conditions during use of an embodiment of an ion source device according to the present invention.

FIG. 10 shows modeled ion trajectories for one set of operating conditions of an embodiment of an ion source device according to the present invention, the embodiment being similar to the embodiments shown in FIGS. 4A–4C, demonstrating electropneumatic capture and axial guidance of ions ejected from the ion introduction or generation means, including ions ejected in an off-axis direction. FIG. 4C shows modeled ion trajectories in perspective view.

As described herein, the extent of ion cooling that occurs in an ion source device of the present invention may be controlled by the gas pressure in the gas reservoir, the configuration of the pneumatic and/or electropneumatic elements in the device, etc. Accordingly, operating the device at an elevated pressures, such that the gas pressures and/or velocities in the ion expansion chamber are correspondingly increased, may result in more rapid collisional cooling of ions introduced in this chamber.

However, one effect that may result from this increased pressure is clustering between ions and matrix material in the device. Such clustering may be undesirable, as the apparent mass and/or charges of the ions may be affected, thereby resulting in problems in subsequent analysis of these ions.

To counter this clustering, the ions may be subjected to a moderate amount of collisional heating in a controlled fashion. This heating may be effected by increasing the ion velocities in either or both the first and the second housings, the heating resulting from increasing the collision rate between the ions and the gases therein.

The ion velocities may be increased by increasing the electric field magnitudes within either or both the first and the second housings in various embodiments of the present invention. For example, by applying appropriate potentials to one or more of the electrostatic and/or electropneumatic elements in the device, the ion velocities are increased, thereby resulting in a moderate amount of collision heating. The appropriate amount of collisional heating may be determined empirically, for example, by increasing the collision heating when the device is being operated at an elevated pressure until the extent of ion/matrix clustering has been reduced to an acceptable level.

As described above, the advantages of an ion source device of the present invention result from, inter alia, controlled superposition of the electrostatic fields and pneumatic fields within the device. The extent of superposition of these two fields is a result of factors such as the physical configuration of the device (e.g., the pneumatic, electrostatic, and electropneumatic elements) and the operating parameters of the device, such as the gas pressures and velocities, and the potentials applied to one or more of the conductive elements.

Figure 12A:
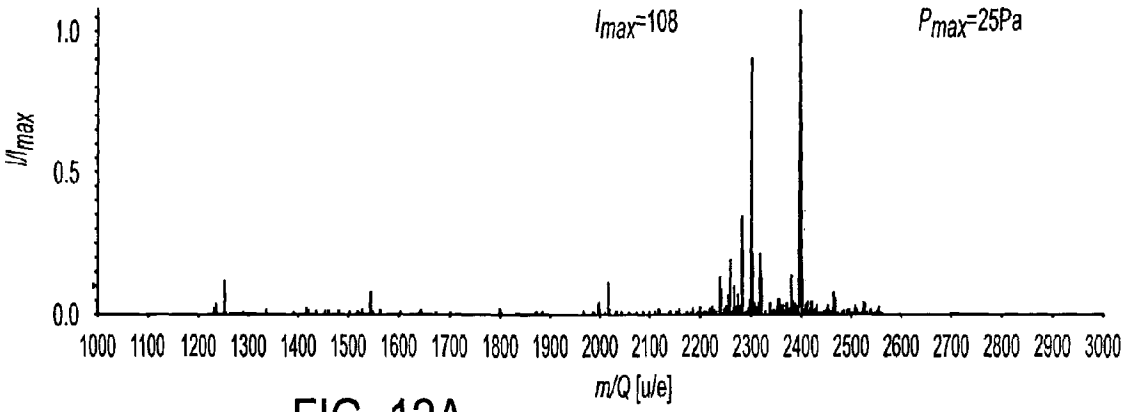
FIGS. 12A and 12B show MALDI experiments performed at different operational pressures during use of an embodiment of an ion source device according to the present invention.
Figure 12B:
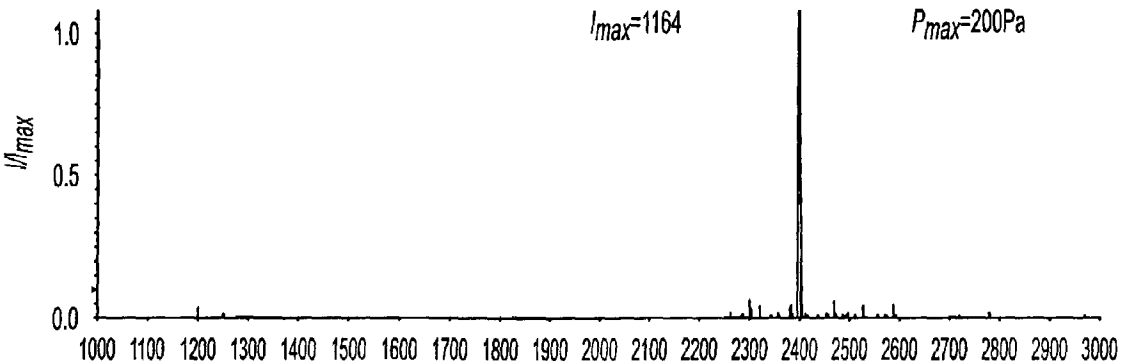

Referring to FIGS. 12A and 12B, experimental results using an ion source embodiment of the present invention is depicted. In these examples, the ion source is used to generate ions from about 10 fmol of a peptide (amino acid residues 661–681 of epithelial growth factor receptor) using a MALDI probe. For each experiment, the ion count for each detected ion was determined (I) and plotted as its ratio of the maximum ion count ($I_{max}$).

FIG. 12A depicts the results of the experiment when performed at a gas pressure of 25 Pa, whereas FIG. 12B depicts the results at a gas pressure of 200 Pa. At the higher pressure, the same ion device produced not only a higher overall ion transmission as indicated by the $I_{max}$, but also a lower amount of fragmentation of the expected ion peak. In contrast, the experiment at the lower pressure resulted in a lower ion transmission and a higher degree of ion fragmentation.

Therefore, although collisional cooling occurred in both examples, the superposition of the electrostatic and pneumatic gas fields in the experiment of FIG. 12B was more effective, thus resulting in both improved ion transmission and a lower degree of ion fragmentation.

Figure 13:
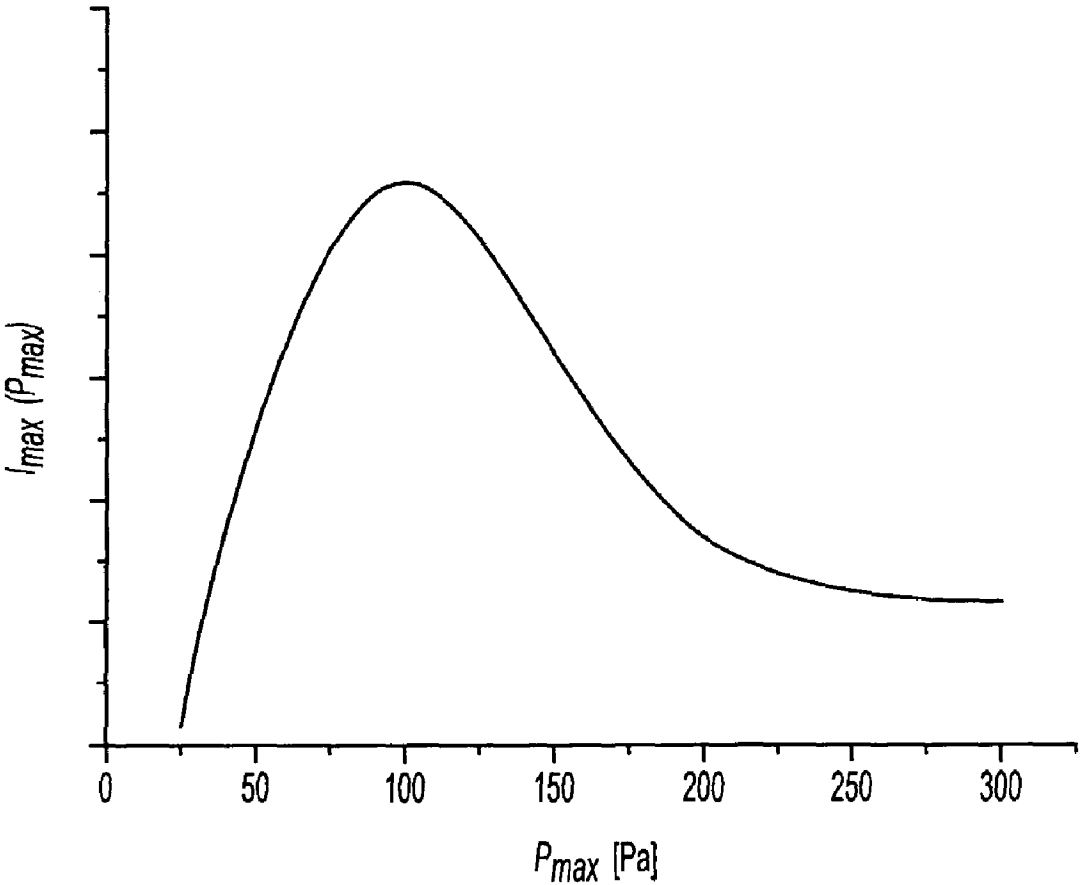
FIG. 13 shows mathematically modeled dependence between the maximal ion count and the operational pressure during use of an embodiment of an ion source device according to the present invention.

Referring to FIG. 13, the pressure dependence on superposition is shown. Here, a prophetic experiment in which the maximal ion count (Imax) is shown to be dependent on the operating pressure in a given embodiment of the present invention. Accordingly, it is desirable to determine the optimum operating pressure when using a given ion device. This optimum pressure may be determined either experimentally, empirically, theoretically, or some combination thereof.

Figure 14A:
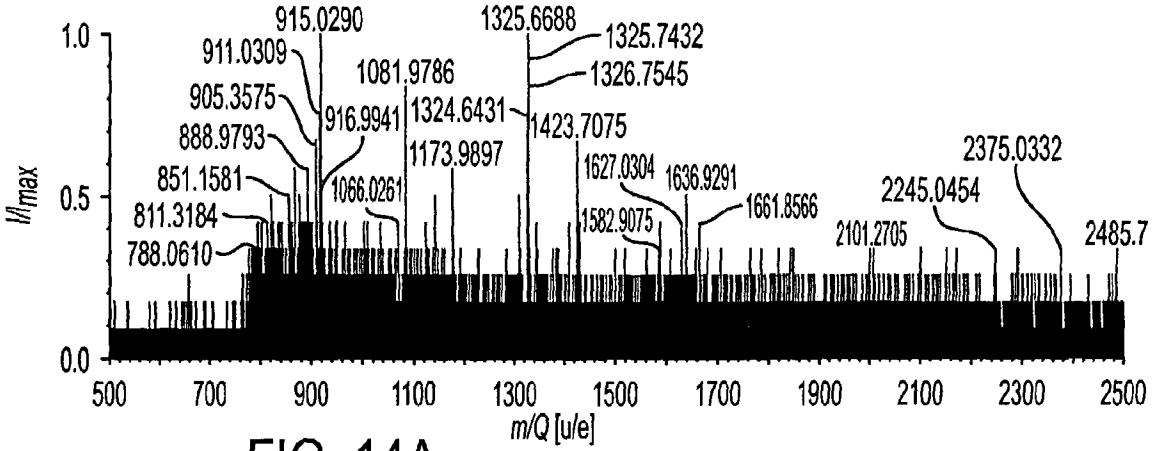
FIGS. 14A and 14B show MALDI experiments using a conventional MALDI ion source and an embodiment of an ion source device according to the present invention.
Figure 14B:
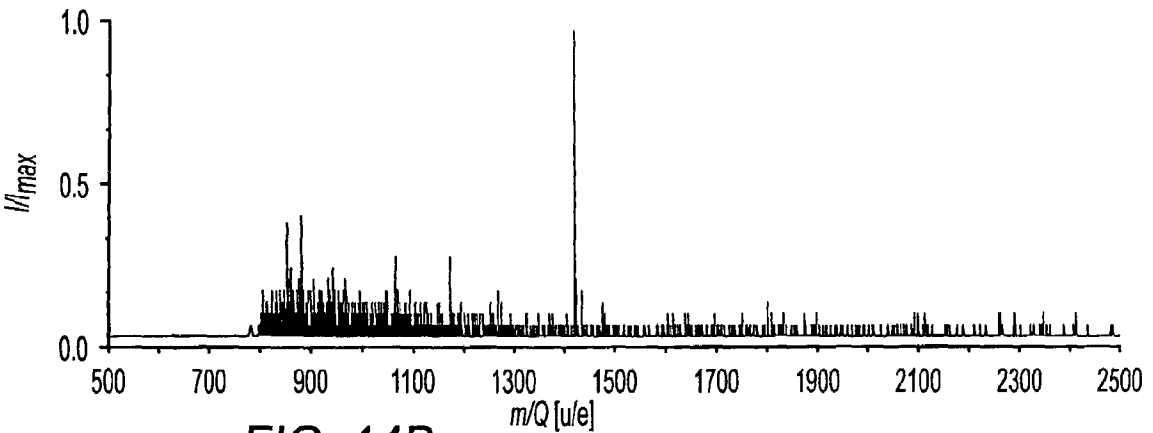

Referring to FIGS. 14A and 14B, the importance of the superposition during use of an ion source of the present invention is further demonstrated. In these examples, each ion source is used to generate ions from about 10 fmol of a peptide (phosphorylated protein kinase C substrate having the amino acid sequence TSTEPQYQPGENL with an expected mass of 1423 Daltons) using a MALDI probe. For each experiment, the ion count for each detected ion was determined (I) and plotted as its ratio of the maximum ion count ($I_{max}$).

In FIG. 14A, the experiment is performed using a prior art MALDI ion source. As is evident from these results, extensive ion fragmentation due to insufficient cooling is apparent. The expected peak of about 1423 mass unit is not even visible as the predominant peak.

In contrast, FIG. 14B depicts the experiment performed using an ion source of the present invention having improved collisional cooling. Here, both the expected mass peak is clearly visible and relatively ion fragmentation has occurred compared to the prior art MALDI source.

As described above, each of the various embodiments of an ion source device according to the present invention comprises ion introduction or generation means, first ion guidance means, and second ion guidance means.

The ion introduction or generation means can, for example, be laser desorption ionization means.

In laser desorption ionization embodiments, ion introduction or generation means 5 can comprise laser desorption ionization probe engagement means, the engagement means being capable of positioning a laser desorption ionization probe so as to display at least one surface thereof to expansion chamber 8. Probe engagement means 5 can, in some embodiments, be in physical and electrical contiguity with an electrically conductive element 28, as suggested by the schematic shown in FIGS. 1–3: in use, electrically conductive element 28, probe engagement means 5, and the laser desorption ionization probe engaged therein can be commonly set to an electrical potential that contributes to an electrostatic field capable of acting upon ions introduced into expansion chamber 8 from the engaged probe.

Figure 11:
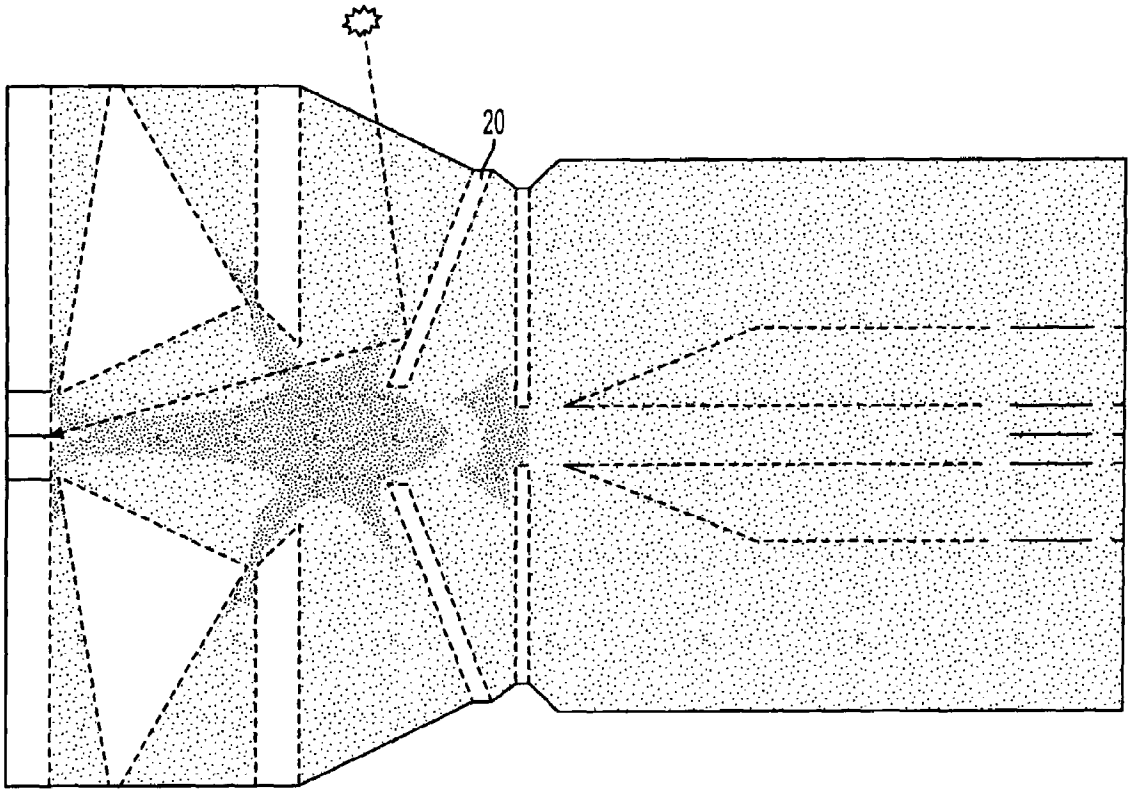
FIG. 11 shows an exemplary laser light path in an axial cross section of a laser desorption ionization embodiment of an ion source device according to the present invention.

In certain laser desorption ionization embodiments of the ion source device of the present invention, the laser is usefully directed to the surface of a laser desorption ionization probe by reflection from a mirrored surface of a pneumatic (optionally, electropneumatic) element 20, as schematized in FIG. 11. A steep incidence angle usefully directs the laser substantially along the device axis, perpendicular to the laser desorption ionization probe, creating highly symmetric initial ion velocities.

In such embodiments, video observation of the laser focal spot and origin of the ions can be achieved using a similar light path, including reflection from a mirrored surface of a pneumatic (optionally, electropneumatic) element 20. In some embodiments of the present invention, the device may include at least two mirrors, wherein the first mirror is used to reflect the incident desorption ionization laser to the probe surface. The second, separate mirror may then be used for video or other optical observation of the laser focal spot on the probe.

As described above, the first ion guidance means are configured to establish ion-guiding pneumatic fields, and optionally electrostatic fields, the ion-guiding pneumatic fields predominating in their effects on ion motion over electrostatic fields during use. The second ion guidance means are configured to establish ion-guiding electrostatic fields and pneumatic fields, the ion-guiding electrostatic fields predominating over pneumatic fields during use.

The pneumatic fields of the first ion guidance means and the second ion guidance means are generated, respectively, by radially inward axisymmetric gas flows and radially outward axisymmetric gas flows. In the embodiment schematically illustrated in FIG. 4B, the radially inward and radially outward axisymmetric gas flows are continuous around the device axis.

In other embodiments of an ion source device according to the present invention, however, the axisymmetric gas flows can be periodic, rather than continuous, with gas flowing through a plurality of channels disposed between element 28 and pneumatic (optionally electropneumatic) elements 6, between adjacent pneumatic (optionally electropneumatic elements) 6, and between pneumatic elements 20, the plurality of channels arranged with radial symmetry. Such embodiments (not shown) usefully reduce the volume of gas flow required to effect ion collection, collisional cooling, and trajectory collimation, thus reducing pumping needs.

FIGS. 1A–1C, 2 and 3 show various embodiments of an ion source device according to the present invention as optionally coupled to the proximal end of an ion analytical instrument.

In the ion source device embodiments schematized in FIGS. 1A, 1B, 1C and 2, the ion source device is operably coupled to analytical instrument 200 through sealing engagement via partition 16, which partition provides, however, for axial communication of ions between axial trajectory region 22 of ion source device 100 and the proximal region of analytical instrument 200 through ion source ion outlet 18.

In the alternative ion source device embodiment schematized in FIG. 3, ion source device 100 is operably coupled to analytical instrument 200 so as effectively to integrate ion source device 100 into ion analytical instrument 200. In such embodiments, partition 16 is omitted and housing 12 of ion source 100 is made contiguous with a housing of ion analytical instrument 200.

Thus, ion source devices of the present invention can be discrete devices, optionally to be coupled to a subsequent ion analytical instrument, or in alternative embodiments can be integrated with an ion analytical instruments.

Thus, in another aspect, the present invention provides analytical apparatus comprising an ion source device of the present invention operably coupled to an ion analytical instrument.

In some embodiments, the analytical instrument comprises at least one multipole, typically an RF multipole, often a quadrupole, hexapole, or octapole, positioned proximal to the ion outlet of the ion source device.

In a variety of these latter embodiments, the ion source device can be coupled to the analytical instrument so as to effect little or no gas input into or output from such a proximally disposed multipole, as schematized in the embodiments of FIGS. 1A, 1B, 1C and 2; in others of the multipole-containing embodiments, the ion source device may instead be coupled to the analytical instrument so as to additionally encourage gas withdrawal from such a proximally disposed multipole, as schematized in the exemplary embodiment of FIG. 3.

The ion analytical instrument of the analytical apparatus can, in some embodiments, comprise at least one mass analyzer, and can comprise a plurality of mass analyzers.

The analytical apparatus can, for example, comprise a mass spectrometer, including both single stage and multistage mass spectrometers, single quadrupole, single hexapole, multiple quadrupole (q2, q3), multiple hexapole, quadrupole ion trap, linear ion trap, ion trap-TOF, and quadrupole-TOF mass spectrometers, orthogonal quadrupole-quadrupole-TOF (Qq-TOF) including orthogonal quadrupole-quadrupole-TOF (Qq-TOF) with linear quadrupole ion trap, orthogonal hexapole-hexapole-TOF including orthogonal hexapole-hexapole-TOF with linear hexapole ion trap mass spectrometers as well as FTIR and Ion Trap-FTIR mass spectrometers.

In a further aspect, the invention provides methods for increasing the collimated output of unfragmented ions from an ion source device, thus increasing the sensitivity of an ion analytical instrument that may optionally be operably coupled to the ion outlet of the ion source.

The method comprises guiding ions introduced into or generated within the ion source device along the device axis to an ion outlet using superposed electrostatic and axisymmetric pneumatic fields, the ion-guiding pneumatic fields predominating in their effects on ion motion over electrostatic fields in a first portion of the ion trajectory, and ion-guiding electrostatic fields predominating in their effects on ion motion over pneumatic fields in a second portion of the ion trajectory. In typical embodiments, the pneumatic fields are generated by establishing radially-inward axisymmetric and radially-outward axisymmetric gas flows in axial succession.

Usefully, the methods are practiced using an ion source device of the present invention as above-described.

Using the ion source device of the present invention, the magnitude of the gas flows is often controlled, at least in part, by controlling gas flows into the gas reservoir, as for example by throttling the inward gas flow. In other embodiments, the magnitude of the gas flows is controlled, at least in part, by controlling gas flows out of the gas sink region, as for example by throttling the outward gas flow and/or by controlling outwardly directed pumping of gas from the gas sink region.

Typically, the magnitude of the gas flows is controlled, at least in part, by controlling both the gas flows into the gas reservoir and gas flow out of the gas sink region.

In the methods of the present invention, the electrostatic fields are typically generated by applying an electrical potential to each of a plurality of electrically conductive elements in the ion source device.

In some embodiments, the potential applied to at least one of the plurality of electrically conductive elements changes between the time of ion introduction into or generation within the ion source device and ion output from the source. In some of these embodiments, the potential applied to a plurality of electrically conductive elements changes during this period.

The change in electrical potential can facilitate injection of ions into an RF multipole of an analytical instrument coupled to the ion source device, as further described in the commonly owned patent application Ser. No. 11/063,801 filed concurrently herewith by Andreas Hieke, entitled "Methods And Apparatus For Controlling Ion Current In An Ion Transmission Device" the disclosure of which is incorporated herein by reference in its entirety. In a variety of such embodiments, the potential applied to at least one of the plurality of the electrically conductive elements is ramped coordinately with AC potential stepping of an RF multipole of an ion analytical instrument to which the ion source device is operably coupled.

The methods of the present invention may comprise a subsequent step of performing at least one analysis on at least one species of ion output from the ion source device.

For example, the analysis can comprise determining the mass to charge (m/z) ratio of at least one species of ion output from the ion source.

If the ion analytical instrument comprises means for performing a plurality of such measurements, either tandem-in-space or tandem-in-time, the methods can usefully comprise the subsequent steps, after guiding ions to the ion source device outlet, of selecting at least one ion species output from the ion source device, often based upon its m/z, fragmenting the at least one selected ion species, and performing at least one analysis on at least one product ion resulting from the fragmented parent ion. Typically, the at least one analysis will comprise a determination of the mass to charge ratio of the product ion. Usefully, the at least one analysis will comprise a product ion scan.

The methods of the present invention comprise a step before the step of guiding ions, of introducing ions into, or generating ions within, the ion source device.

Any means of introducing ions into, or generating ions within, the source can be used, such as laser desorption ionization.

In various embodiments, ions are generated within the source by laser desorption ionization of a sample disposed on at least one surface of a laser desorption ionization probe. The analytical sample can usefully comprise proteins, the ions being generated from one or more proteins in the sample. In some of these embodiments, the method can further comprise the step, before generating ions, of capturing proteins from inhomogeneous admixture onto a surface of a laser desorption ionization probe, such as a surface enhanced laser desorption probe, such as a ProteinChip® Array available commercially from Ciphergen Biosystems, Inc. (Fremont, Calif., USA).

All patents, patent publications, and other published references mentioned herein are hereby incorporated by reference in their entireties as if each had been individually and specifically incorporated by reference herein.

While preferred illustrative embodiments of the present invention are described, it will be apparent to one skilled in the art that various changes and modifications may be made therein without departing from the invention, and it is intended in the appended claims to cover all such changes and modifications that fall within the true spirit and scope of the invention.

An element in a claim is intended to invoke 35 U.S.C. § 112 paragraph 6 if and only if it explicitly includes the phrase "means for," "step for," or "steps for." The phrases "step of" and "steps of," whether included in an element in a claim or in a preamble, are not intended to invoke 35 U.S.C. § 112 paragraph 6.

What is claimed is:

1. A device for outputting ions, the device comprising:

a first housing; and a second housing, wherein said first housing comprises at least one pneumatic element that segregates the space within the first housing into a gas reservoir and an ion expansion chamber, the gas reservoir being in axisymmetric gas communication with the ion expansion chamber and in gas communication with the exterior of said first housing;

wherein said second housing comprises at least one pneumatic element that segregates the space within the second housing into an axial trajectory region and a gas sink region, the gas sink region being in axisymmetric gas communication with the axial trajectory region and in gas communication with the exterior of said second housing;

wherein the first housing expansion chamber is axially aligned with and in gas and ion communication with the second housing axial trajectory region and wherein the second housing axial trajectory region is in axial alignment with and in ion communication with an ion outlet of the device, wherein ions introduced into the ion expansion chamber are guided during use along the device axis from the expansion chamber through the axial trajectory region to the ion outlet by pneumatic and electrostatic fields, and wherein the pneumatic and electrostatic fields are superposed.

2. The device of claim 1, wherein the ions guided during use are guided predominantly by pneumatic fields in the first housing and predominantly by electrostatic fields in the second housing.

3. The device of claim 1, wherein said first housing comprises a plurality of pneumatic elements that segregate the space within the first housing into a gas reservoir and an ion expansion chamber, the gas reservoir being in axisymmetric gas communication with the ion expansion chamber and in gas communication with the exterior of said first housing.

4. The device of claim 3, wherein said second housing comprises a plurality of pneumatic elements that segregate the space within the second housing into an axial trajectory region and a gas sink region, the gas sink region being in axisymmetric gas communication with the axial trajectory region and in gas communication with the exterior of said second housing.

5. The device of claim 3, wherein at least a portion of the plurality of said first housing pneumatic elements is electrically conductive.

6. The device of claim 5, wherein each of the plurality of first housing pneumatic elements is electrically conductive.

7. The device of claim 5 or 6, wherein said first housing electrically conductive elements are capable of creating an electric field that is capable of affecting ion trajectory in the ion expansion chamber.

8. The device of claim 4, wherein at least a portion of the plurality of said second housing pneumatic elements is electrically conductive.

9. The device of claim 8, wherein each of the plurality of second housing pneumatic elements is electrically conductive.

10. The device of claim 8 or 9, wherein said second housing electrically conductive elements are capable of creating an electrostatic field capable of guiding ions axially through the axial trajectory region to a device outlet that communicates the axial trajectory region with the exterior of said second housing.

11. The device of claim 1, further comprising:

means for introducing ions into the expansion chamber.

12. The device of claim 11, wherein said means comprises engagement means for a laser desorption ionization probe, the engagement means being capable of positioning a laser desorption ionization probe so as to display at least one surface thereof to the expansion chamber.

13. The device of claim 12, wherein said probe engagement means is in physical and electrical contiguity to an electrically conductive element.

14. The device of claim 1, wherein said first housing comprises at least one gas inlet that communicates the gas reservoir with the exterior of said first housing.

15. The device of claim 14, wherein said second housing comprises at least one gas outlet that communicates the gas sink region with the exterior of said second housing.

16. The device of claim 1, wherein one or more of said at least one first housing pneumatic elements is so shaped and so disposed that maximal constriction to axisymmetric gas flow between the gas reservoir and expansion chamber is located proximal to the expansion chamber.

17. The device of claim 1, wherein the gas communication between the gas reservoir and expansion chamber is continuously axisymmetric.

18. The device of claim 1, wherein the gas communication between the gas reservoir and expansion chamber is periodically axisymmetric.

19. The device of claim 1, wherein said first and second housings are of integral construction.

20. An ion source device, the device comprising:

ion introduction or generating means;

first ion guidance means; and second ion guidance means, wherein said first ion guidance means are configured to establish a first superposed electrostatic fields and pneumatic fields, wherein said second ion guidance means are configured to establish a second superposed electrostatic fields and pneumatic fields, and wherein, during use, ions introduced or generated by said ion introducing or generating means are guided by the first and second superposed electrostatic fields and pneumatic fields along the device axis to a device outlet.

21. The device of claim 20, wherein the pneumatic fields of the first superposed fields is predominantly ion-guiding in the first housing, and wherein the electrostatic fields of the second superposed fields is predominantly ion-guiding in the second housing.

22. The device of claim 20, wherein said first ion guidance means is disposed in a first housing, wherein said second ion guidance means is disposed in a second housing, and wherein said first housing is in axial ion and gas flow communication with said second housing.

23. The device of claim 22, wherein said first ion guidance means comprises at least one electropneumatic element, the at least one electropneumatic element segregating the space within the first housing into a gas reservoir and an ion expansion chamber, the gas reservoir being in axisymmetric gas communication with the ion expansion chamber.

24. The device of claim 22, wherein at least one of said electropneumatic elements is so shaped and so disposed within said first housing as to create radially inwardly-directed axisymmetric gas flow when the gas reservoir is at a higher pressure than the expansion chamber.

25. The device of claim 22, wherein said second ion guidance means comprises at least one electropneumatic element, the at least one electropneumatic element segregating the space within the second housing into an axial trajectory region and a gas sink region, the axial trajectory region being in axisymmetric gas communication with the gas sink region.

26. The device of claim 25, wherein at least one of said electropneumatic elements is so shaped and so disposed within said second housing as to create radially outward-directed axisymmetric gas flow when the axial trajectory region is at a higher pressure than the gas sink region.

27. The device of claim 22, wherein said first housing comprises at least one symmetrically disposed gas inlet that communicates the gas reservoir with the exterior of the first housing.

28. The device of claim 22, wherein said second housing comprises at least one gas outlet that communicates the gas sink region with the exterior of the second housing.

29. The device of claim 20, wherein said ion generating means generates ions within the expansion chamber.

30. The device of claim 29, wherein said ion generating means is a laser desorption ionization ion source.

31. Analytical apparatus, comprising:

an ion source device according to claim 1, operably coupled to an ion analytical instrument.

32. The analytical apparatus of claim 31, wherein said ion analytical instrument comprises at least one RF multipole ion guide.

33. The analytical apparatus of claim 32, wherein at least one of the at least one multipoles is a quadrupole, a hexapole, or an octapole.

34. The analytical apparatus of claim 32, wherein the operative coupling of said ion source to said ion analytical instrument permits said ion source to draw gas proximally outward from said multipole during use.

35. The analytical apparatus of claim 31, wherein the ion analytical instrument comprises at least one mass analyzer.

36. The analytical apparatus of claim 31, wherein the ion analytical instrument comprises a plurality of mass analyzers.

37. A method of increasing the collimated output of ions from an ion source device, the method comprising:

guiding ions introduced into or generated within said source along the device axis to an ion source outlet using superposed electrostatic and axisymmetric pneumatic fields.

38. The method of claim 37, wherein ion-guiding pneumatic fields predominate in their effects on ion motion over electrostatic fields in a first portion of the ion trajectory and ion-guiding electrostatic fields predominate in their effects on ion motion over pneumatic fields in a second portion of the ion trajectory.

39. The method of claim 37, wherein the pneumatic fields are generated by establishing radially-inward axisymmetric and radially-outward axisymmetric gas flows in axial succession.

40. The method of claim 37, wherein said ion source device is a device according to claim 1 or claim 31.

41. The method of claim 40, wherein the magnitude of the gas flows is controlled in part by controlling gas flows into the gas reservoir.

42. The method of claim 37, wherein the electrostatic fields are generated by applying an electrical potential to each of a plurality of electrically conductive elements in said ion source device.

43. The method of claim 37, further comprising a subsequent step of:

performing at least one analysis on at least one species of ion output from said ion source device.

44. The method of claim 43, wherein said at least one analysis comprises:

determining the at least one ion's mass to charge ratio.

45. The method of claim 37, further comprising the subsequent steps of:

selecting at least one ion species output from said ion source device;

fragmenting said at least one selected ion species; and performing at least one analysis on at least one product ion resulting from fragmenting said at least one selected ion.

46. The method of claim 45, wherein performing said at least one analysis comprises:

determining the mass to charge ratio of said at least one product ion.

47. The method of claim 37, further comprising, before the step of guiding ions, the step of:

introducing ions into or generating ions within said ion source device.

48. The method of claim 47, wherein introducing or generating ions comprises:

generating ions by laser desorption ionization of an analytical sample.

49. The method of claim 48, wherein said analytical sample comprises proteins and said ions are ions generated from said proteins.

50. The method of claim 49, further comprising the step, before generating ions, of:

capturing proteins from an inhomogeneous mixture on a surface of a laser desorption ionization probe.

* * * * *